US007783481B2

(12) United States Patent
Endo et al.

(10) Patent No.: US 7,783,481 B2
(45) Date of Patent: Aug. 24, 2010

(54) NOISE REDUCTION APPARATUS AND NOISE REDUCING METHOD

(75) Inventors: Kaori Endo, Kawasaki (JP); Takeshi Otani, Kawasaki (JP); Mitsuyoshi Matsubara, Yokohama (JP); Yasuji Ota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1070 days.

(21) Appl. No.: 10/851,701

(22) Filed: May 20, 2004

(65) Prior Publication Data

US 2005/0143988 A1 Jun. 30, 2005

(30) Foreign Application Priority Data

Dec. 3, 2003 (JP) ..... 2003-404595

(51) Int. Cl.
*G10L 21/02* (2006.01)

(52) U.S. Cl. ..... 704/226

(58) Field of Classification Search ..... 704/226, 704/233

See application file for complete search history.

(56) References Cited

U.S. PATENT DOCUMENTS

| | | | | |
|---|---|---|---|---|
| 4,811,404 | A | 3/1989 | Vilmur et al. | |
| 6,122,384 | A * | 9/2000 | Mauro | 381/94.3 |
| 6,415,253 | B1 * | 7/2002 | Johnson | 704/210 |
| 2002/0156623 | A1 | 10/2002 | Yoshida | |
| 2003/0220786 | A1 | 11/2003 | Chandran et al. | |

FOREIGN PATENT DOCUMENTS

| | | |
|---|---|---|
| JP | 4-340599 | 11/1992 |
| JP | 3437264 B2 | 1/1996 |
| JP | 3269969 | 12/1997 |
| JP | 2000-47697 | 2/2000 |
| JP | 2000-330597 | 11/2000 |
| JP | 2002-73066 | 3/2002 |

OTHER PUBLICATIONS

European Search Report dated May 31, 2006.

Steven F. Boll Suppression of Acoustic Noise in Speech Using Spectral Subtraction. IEEE Transactions on Acoustics, Speech and Signal Processing, vol. ASSP-27, No. 2, Apr. 1979.

Shigeo Tsujii et al. Digital Signal Processing. Partial English Translation p. 111, 1.20-p. 113 1.5 ISBN4-7856-2006-4, Apr. 16, 1990.

Curtis Roads. The Computer Tutorial , Partial English Translation p. 452 1.19-p. 455, 1.6 Jan. 20, 2001.

Notice of Rejection Ground mailed Aug. 25, 2009, from the corresponding Japanese Application.

* cited by examiner

*Primary Examiner*—Angela A Armstrong
(74) *Attorney, Agent, or Firm*—Katten Muchin Rosenman LLP

(57) ABSTRACT

A noise reduction apparatus includes an analysis unit for converting input into a signal of a frequency area, a suppression unit for suppressing the signal, and a synthesis unit for synthesizing a signal of a time area. The apparatus further includes an estimation unit for estimating, using the output of the analysis unit, information corresponding to at least pure voice element excluding noise element in an input voice signal as voice information which is the basic voice information for calculation of a suppression gain of a signal, and a unit for calculating a suppression gain corresponding to the output of the estimation unit and the analysis unit and providing it for the suppression unit.

14 Claims, 20 Drawing Sheets

NOISE REDUCTION APPARATUS AND NOISE REDUCING METHOD

BACKGROUND OF THE INVENTION

1. Field of the Invention

The present invention relates to a system for reducing a noise element from a noise superposed voice signal such as environmental noise, etc., and more specifically to a noise reduction apparatus and a noise reducing method for reducing a noise element from a nonvoice environmental noise superposed voice signal input from a microphone in, for example, a mobile telephone system, an IP phone system, etc., improving a signal-to-noise ratio (SNR), and enhancing the speech communication quality.

2. Description of the Related Art

Recently, digital mobile communications systems such as mobile telephones, etc. have become widespread. In such communications, the communications are commonly established with large environmental noise, and it is important to effectively suppress the noise element contained in a voice signal.

In the above-mentioned noise suppression technology, for example, an input signal on a time axis is converted into a signal on a frequency axis (amplitude spectrum and phase spectrum), a suppression gain is obtained from the background noise estimated by a signal of a nonvoice interval, an amplitude spectrum is suppressed, the phase spectrum and the suppressed amplitude spectrum are restored into a signal on a time axis, thereby eliminating the noise (FIG. 1).

The problem with the above-mentioned conventional technology is described below by referring to the following four documents.

[Nonpatent Document] S. F. Boll, "Suppression of Acoustic Noise in Speech Using Spectral Subtraction", IEEE Transaction on Acoustics, Speech, and Signal Processing, ASSP-33, vol. 27, pp. 113-120, (1979)

[Patent Document 1] Japanese Patent Publication No. 3269969 "Background Noise Elimination Apparatus

[Patent Document 2] Japanese Patent Publication No. 3437264 "Noise Suppression Apparatus"

[Patent Document 3] Japanese Patent Application Laid-open No. 2002-73066 "Noise Suppression Apparatus and Noise Suppressing Method"

In Nonpatent Document 1, the technology of spectrum subtraction, obtaining suppressed amplitude spectrum by subtracting the amplitude spectrum of the estimated noise from the input amplitude spectrum, is proposed.

In Patent Document 1, an input signal is converted into a signal on a frequency axis, and a suppression gain is calculated based on the signal-to-noise ratio (SNR) calculated from the input signal and the estimated noise. The method of calculating a suppression gain is to empirically set a relational expression between the SNR and the suppression gain.

In Patent Document 2, when the power in the estimated nonvoice interval is small, the suppression level is lowered to avoid the degradation by suppressed voice interval of small power. When the power in the nonvoice interval is large, the suppression level is enhanced to further suppressing the nonvoice interval, thereby more appropriately suppressing the noise in the nonvoice interval.

In Patent Document 3, the power of a voice signal is obtained from the smoothing spectrum power in a voice-recognized interval, and the power of a no-voice signal is obtained from the smoothing spectrum power in a voice-unrecognized interval, thereby calculating the SNR, strongly suppressing noise on the signal portion having a high SNR, and restricting suppression on the portion distorted by suppression.

However, in the above-mentioned conventional technology, when the estimation of the background noise is incorrect, no appropriate suppression gain can be obtained, and the noise-suppressed voice signal is degraded. For example, when much bubble noise (background noise containing human voice) is contained in the background noise, the interval of bubble noise is not determined as a nonvoice interval, and estimated noise is calculated in an interval of constant noise other than the bubble noise. When the power of the constant noise is smaller than the power of the bubble noise, the estimated noise is underestimated in bubble noise interval, thereby causing insufficient suppression, that is, sufficient suppression cannot be realized.

In Patent Document 2, the power in the estimated voice interval is estimated as the maximum value of the short interval power in a long interval without considering the distribution of voice power. When the distribution of voice power changes depending on the characteristic of human voice and the speaking style is not considered, there is the problem that an appropriate suppression coefficient cannot be necessarily calculated. For example, when the distribution of the voice power is widely performed, there is voice having small power although the maximum value of the voice power is large. Therefore, the voice can be degraded if the suppression is too strong.

Thus, since the pure voice power, which is obtained by subtracting the noise element from an input voice signal, is not detected and its distribution is not estimated in the conventional technology, an appropriate suppression gain cannot be calculated when the background noise is mistakenly estimated.

SUMMARY OF THE INVENTION

The present invention has been developed to solve the above-mentioned problems, and aims at providing a noise reduction apparatus and a noise reducing method capable of appropriately suppressing noise when there is various background noise by estimating the information about the pure voice power contained in an input voice signal, and calculating a suppression gain based on the distribution and the range of voice power.

The first noise reduction apparatus according to the present invention having an analysis unit for analyzing the frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area includes: a voice information estimation device for estimating, using output of the analysis unit, the information for use as basic information in calculating a suppression gain of a signal, which is the information corresponding to at least the pure voice element excluding a noise element in the input voice signal; and a suppression gain calculation device for calculating the suppression gain corresponding to the output of the voice information estimation device and the analysis unit, and providing a calculation result for the suppression unit.

The second noise reduction apparatus according to the present invention having an analysis unit for analyzing the frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area includes: a noise estimation device for estimating the spectrum of a noise element in the input voice signal; a voice information estimation device for estimating, using output of the analysis unit, the information for use as basic information in calculating a suppression gain of a signal, which is the information corresponding to at least the pure voice element excluding a noise element in the input voice signal; and a suppression gain calculation device for calculating the suppression gain corresponding to the output of the noise estimation device, the voice information estimation device, and the analysis unit, and providing a calculation result for the suppression unit.

The first noise reducing method according to the present invention reduces noise using an analysis unit for analyzing the frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area, and performs: estimating, using output of the analysis unit, the information for use as basic information in calculating a suppression gain of a signal, which is the information corresponding to at least the pure voice element excluding a noise element in the input voice signal; calculating the suppression gain corresponding to the estimated voice information and the output of the analysis unit, and providing a calculation result for the suppression unit.

The second noise reducing method according to the present invention reduces noise using an analysis unit for analyzing the frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area, and performs: estimating the spectrum of a noise element in the input voice signal; estimating, using output of the analysis unit, the information for use as basic information in calculating a suppression gain of a signal, which is the information corresponding to at least the pure voice element excluding a noise element in the input voice signal; calculating the suppression gain corresponding to the estimated noise element spectrum, the estimated voice information, and the output of the analysis unit, and providing a calculation result for the suppression unit.

DESCRIPTION OF THE PREFERRED EMBODIMENTS

Figure 2:
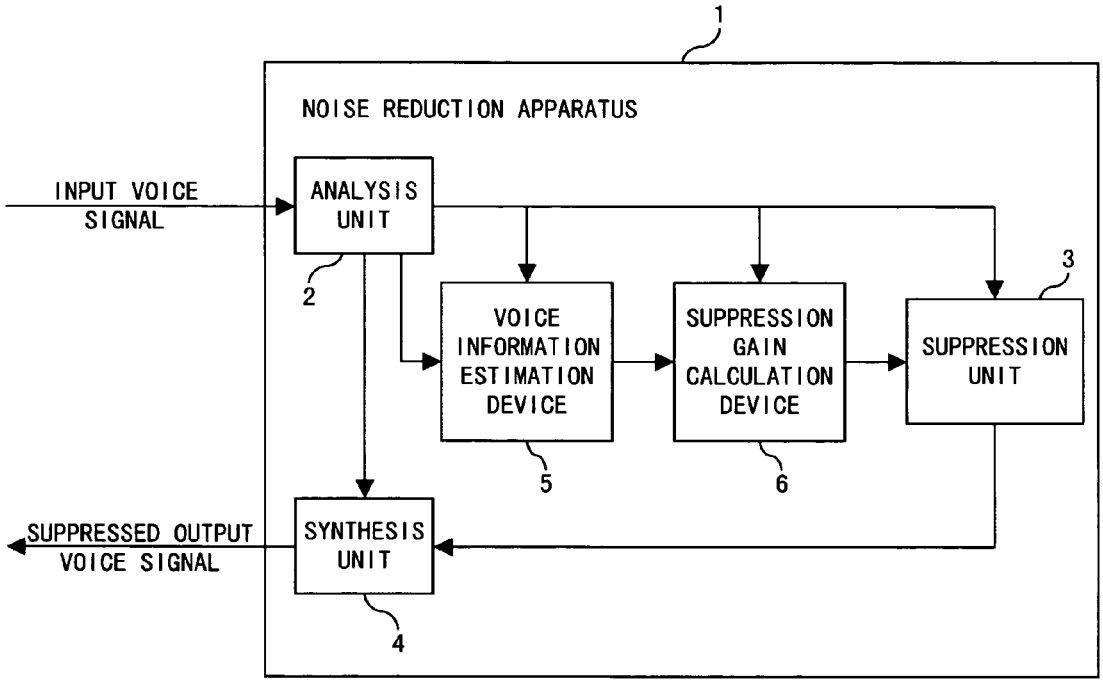
FIG. 2 is a block diagram of the configuration showing the principle of the noise reduction apparatus according to the present invention.

FIG. 2 is a block diagram of the configuration showing the principle of the noise reduction apparatus according to the present invention. FIG. 2 is a block diagram of the configuration showing the principle of a noise reduction apparatus 1 comprising: a analysis unit 2 for analyzing the frequency of an input voice signal and converting it into a signal of a frequency area; a suppression unit 3 for suppressing the signal of the frequency area; and a synthesis unit 4 for synthesizing and outputting a signal of a suppressed time area using the suppressed signal of the frequency area.

The noise reduction apparatus 1 according to the present invention further comprises at least a voice information estimation device 5, and a suppression gain calculation device 6. The voice information estimation device 5 estimates as voice information, using a signal of a frequency area output by the analysis unit 2, for example, spectrum amplitude, the information which is the basic information for use in calculating a suppression gain of a signal and is the information corresponding to a pure voice element excluding at least a noise element in the input voice signal. The suppression gain calculation device 6 calculates a suppression gain corresponding to the output of the voice information estimation device 5 and the analysis unit 2, and provides the result to the suppression unit 3.

In the embodiment of the present invention, the voice information estimation device 5 can estimate the power of the pure voice element, or can estimate an average value of the power indicating the number of samples totalized from the largest power as a predetermined ratio of the number of samples in the power distribution in each frequency of pure voice for a plurality of previously input voice signal frames.

In this case, the suppression gain calculation device 6 can also calculate the suppression gain for the frame k based on the difference between the power average value PMAXki corresponding to the frequency index i of the frame k currently to be processed and the spectrum power Pki corresponding to the frame k.

Furthermore, according to the embodiment of the present invention, the voice information estimation device 5 can also calculate the power distribution of the noise superposed voice signal as an input voice signal in addition to the estimated value of the power distribution of the pure voice as the information corresponding to the pure voice element, as the information for use in calculating the suppression gain by the voice information estimation device 5 and provide a result for the suppression gain calculation device 6.

In this case, the voice information estimation device 5 can also estimate the probability density function corresponding to the power distribution of the pure voice using two average values of power indicating the number of samples totalized from the largest power in a predetermined ratio of the total number of samples in the power distribution in each frequency of pure voice for a plurality of previously input voice signal frames, and the suppression gain calculation device 6 can divide the power distribution into a plurality of intervals such that the number of samples totalized from the largest power can be a predetermined ratio of the total samples for each of the distribution of the pure voice power and the power distribution of the noise superposed voice signal as the output of the voice information estimation device 5, and can obtain the suppression gain based on the average value of the power in each of the plurality of intervals.

Furthermore, the noise reduction apparatus of the present invention further comprises a noise estimation device for estimating the spectrum of the noise element in the input voice signal in addition to the analysis unit 2, the suppression unit 3, the synthesis unit 4, and the voice information estimation device 5, and the suppression gain calculation device calculates a suppression gain corresponding to the output of the noise estimation device, the voice information estimation device, and the analysis unit 2.

In the noise reduction apparatus, as described above, the voice information estimation device 5 can estimate the power of the pure voice signal, and can also estimate the average value of the power indicating the number of samples totalized from the largest power as a predetermined ratio of the total number or samples in the distribution of the pure voice power for the plurality of voice frames.

In this case, the suppression gain calculation device 6 can also calculate the suppression gain based on the difference between the power average value PMAXki and the spectrum power Pki and the difference between PMAXki and the spectrum noise Nki in response to the input of the power average value PMAXki, the spectrum noise Nki for the current frame as the output of the noise estimation device, and the spectrum power Pki of the current frame.

Otherwise, the suppression gain calculation device 6 can also estimate the lower limit of the pure voice power, calculate the frequency Hki in which inconstant noise has been detected in the plurality of previously input voice frame signals including the current frame using the estimation result, and calculate the suppression gain based on the difference between the power average value PMAXki and the spectrum power Pki, the difference between the power average value PMAXki and the spectrum noise Nki, and the frequency Hki in response to the input of the power average value PMAXki, the spectrum noise Nki, and the spectrum power Pki.

The noise reducing method according to the present invention reduces noise using the above-mentioned analysis unit, the suppression unit, and the synthesis unit, estimates, using the output of the analysis unit, the information for use as basic information in calculating a suppression gain of a signal, which corresponds to the pure voice element excluding the noise in the input voice signal, as voice information, calculates the suppression gain corresponding to the estimation result and the output of the analysis unit, and provides the result for the suppression unit.

The noise reducing method according to the embodiment of the present invention estimates the above-mentioned voice information, estimates the spectrum of the noise element in the input voice signal, calculates the suppression gain corresponding to the estimated voice information, the estimated noise spectrum, and the output of the analysis unit, and provides the result for the suppression unit.

According to the embodiment of the present invention, corresponding to the two methods, a program used to direct a computer to realize the noise reducing method, and a portable storage medium storing the program can also be applied.

According to the present embodiment, the power information about the pure voice can be estimated without estimating noise, and the suppression gain is calculated based on its distribution and range. Therefore, voice suppression can be realized without an influence of the noise estimating capability, thereby obtaining a high quality voice signal. Furthermore, in addition to the power distribution of the pure voice, the power distribution of the noise superposed voice can be used in calculating a suppression gain, and a suppression gain can be calculated with the influence of the noise power superposed on the voice interval. Therefore, the suppression gain can be more correctly obtained as compared with the conventional method of using the noise estimated value estimated in a noise interval even if inconstant noise is superposed.

Furthermore, according to the present invention, in addition to the estimated value of the power information about the pure voice, the noise is further estimated, and the suppression gain is calculated using the result, the suppression gain can be calculated based on the power distribution of the pure voice, the range of the location, and the noise power estimated. Therefore, even if inconstant noise is superposed, the suppression gain can be more correctly obtained as compared with the conventional method using the estimated noise value calculated simply in a noise interval. Furthermore, the suppression gain can also be calculated using the frequency of inconstant noise. Therefore, the noise can be more correctly suppressed, and, for example, the communications quality in a mobile communication can be much improved.

Figure 3:
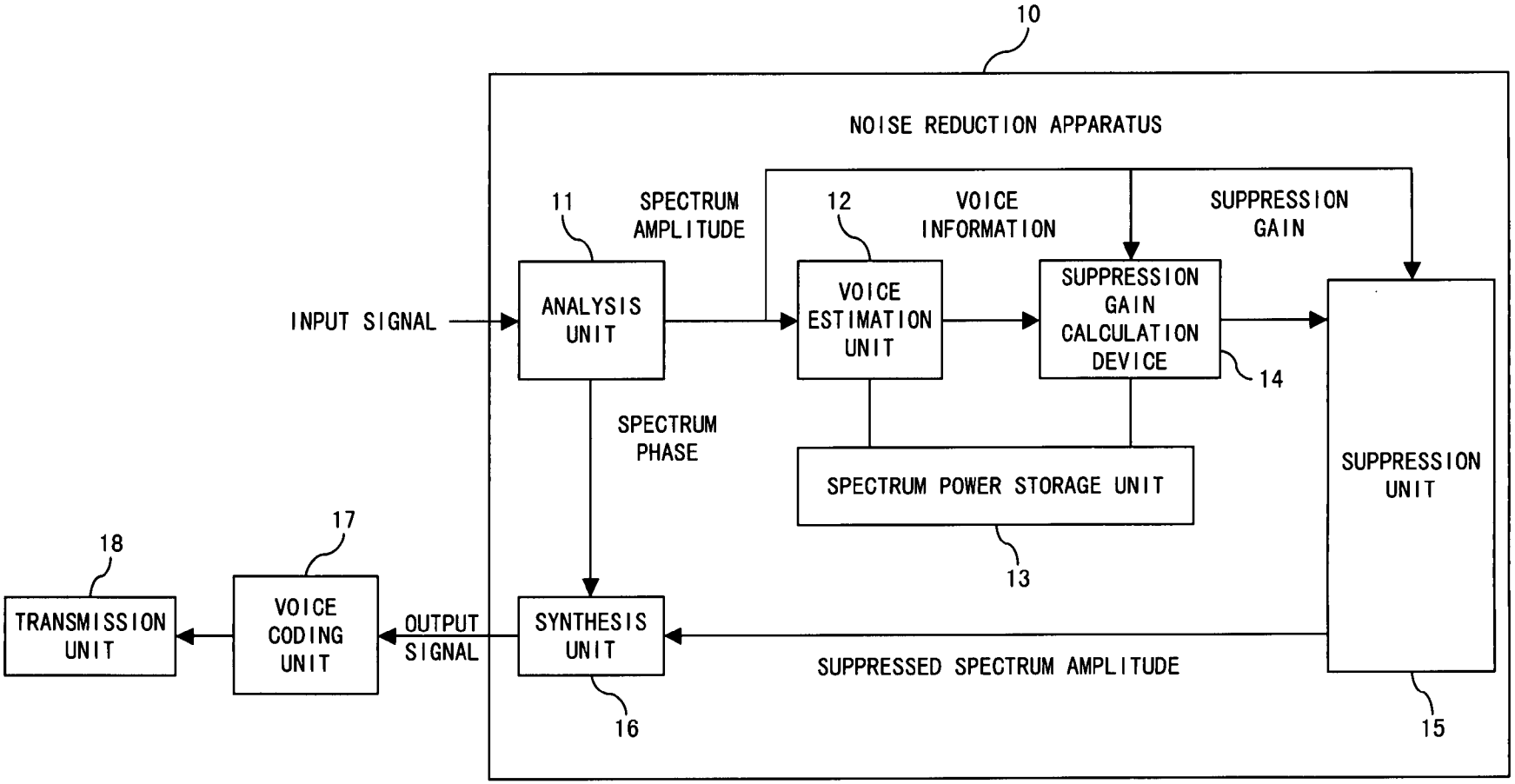
FIG. 3 shows an example of the configuration of the noise reduction apparatus according to the first embodiment of the present invention.

FIG. 3 is a block diagram showing the configuration of the noise reduction apparatus with the voice signal according to the first embodiment of the present invention. In FIG. 3, an analysis unit 11 receives an input signal for each frame, that is, the input of the noise superposed voice signal, analyzes an input frame using a fast Fourier transform FFT after a time window is applied such as a Hamming window, etc., and calculates the spectrum amplitude (=amplitude spectrum) and the spectrum phase (=phase spectrum) The FFT and the window in the input signal are explained in detail in the following documents.

[Nonpatent Document 2] Tsujii, Kamata "Digital Signal Processing Series vol. 1, Digital Signal Processing" 94 to 120 page, published by Shoko Do

[Nonpatent Document 3] Curtis Road, translated by Aoyagi, etc. "Computer Music] pp. 452-457, published by Tokyo Denki University.

Figure 1:
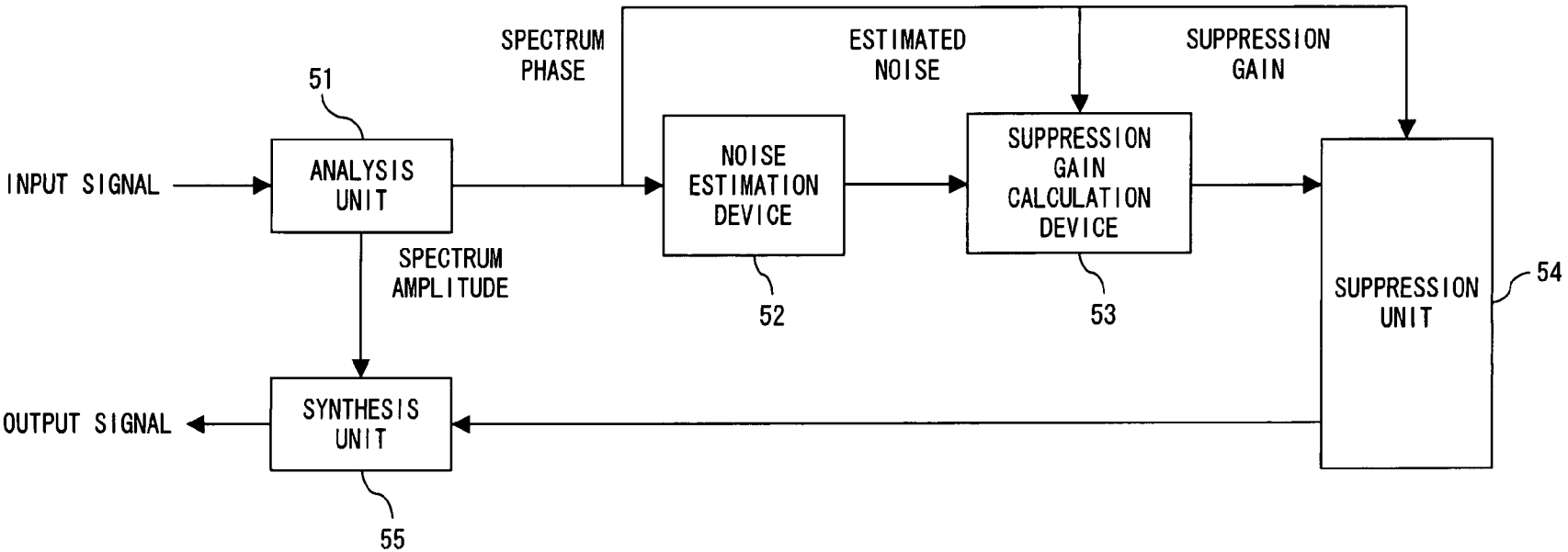
FIG. 1 PRIOR ART
FIG. 1 is a block diagram showing the configuration of the conventional technology of the noise reduction apparatus.

The spectrum amplitude as the output of the analysis unit 11 is provided for a voice estimation unit 12, a suppression gain calculation device 14, and a suppression unit 15. The voice estimation unit 12 estimates the information corresponding to the element excluding the noise from the noise superposed input voice signal using the spectrum amplitude of the input signal, that is, corresponding to the pure voice signal, that is, the voice information for use in calculating a suppression gain. In the first embodiment, instead of calculating a suppression gain by estimating noise as explained by referring to FIG. 1, the voice information corresponding to the pure voice signal is estimated, and the suppression gain is calculated.

A spectrum power storage unit 13 stores the value of the spectrum power corresponding to, for example, the past 100 frames, and provides it for the voice estimation unit 12 and the suppression gain calculation device 14.

The suppression gain calculation device 14 calculates the suppression gain for adjustment of the spectrum amplitude using the voice information as the output of the voice estimation unit 12 and the spectrum amplitude of the input signal. The suppression unit 15 calculates the suppressed spectrum amplitude using the value of the calculated suppression gain and the spectrum amplitude of the input signal, and provides the result for a synthesis unit 16.

The synthesis unit 16 converts the signal on the frequency axis into a signal on the time axis by an inverse fast Fourier transform IFFT using the suppressed spectrum amplitude and the spectrum phase output by the analysis unit 11, overlaps it on the suppressed voice on the time axis in the previous frame in the overlapping calculation, and outputs the result as the suppressed output voice signal. Described above are the operations of the noise reduction apparatus 10, but the output signal of the synthesis unit 16 is, for example, provided for a voice coding unit 17, and the coding result is transmitted by a transmission unit 18, thereby applying to the voice communications system.

The reason why the synthesis unit 16 overlaps the signal converted on the time axis and the suppressed voice on the time axis in the previous frame in the overlapping addition is that the signal reduced outside the window by the window process in the FFT can be corrected, which is generally executed as the well-known technology.

Figure 4:
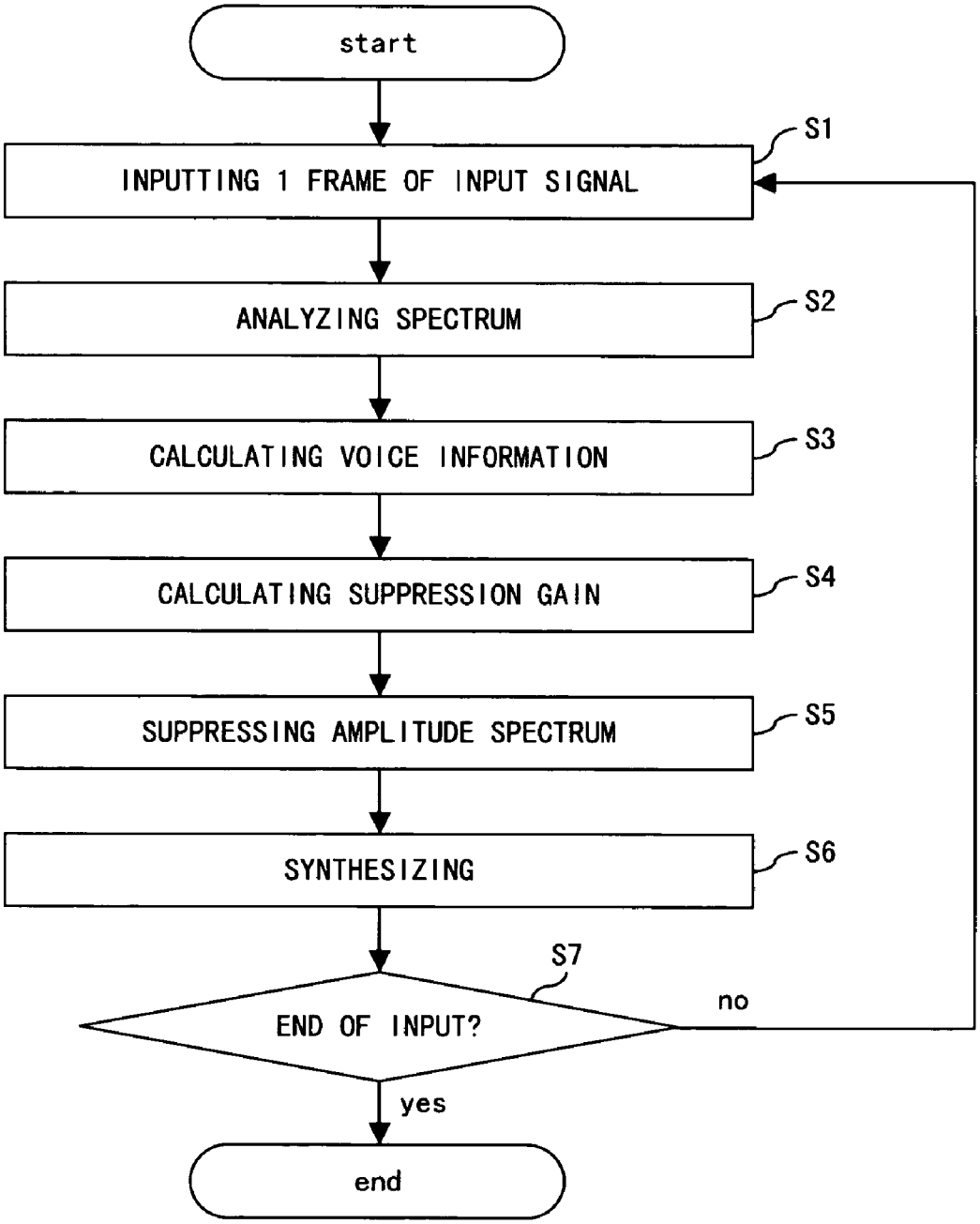
FIG. 4 is a flowchart of the entire noise reducing process according to the first embodiment of the present invention.

FIG. 4 is a flowchart of the entire noise reducing process by the noise reduction apparatus shown in FIG. 3. In FIG. 4, 1 frame of input signal is input in step S1. In step S2, after a time window process is performed using a Hamming window, etc., the FFT analysis is performed and the spectrum amplitude SAki and the spectrum phase SPki are obtained as a result of the spectrum analysis. In this example, k indicates an index of a frame, and i indicates the frequency (band).

Then, in step S3, the voice information is estimated. In this example, the voice information as the basic information in calculating a suppression gain is calculated using the spectrum amplitude SAki of an input signal, and the details are described later. The suppression gain Gki is calculated from the voice information calculation result in step S4, and the suppressed amplitude spectrum SA'ki is calculated using the next equation (1) in step S5.

$$SA'ki=SAki\cdot Gki \quad 0\leqq i<N \tag{1}$$

Using the suppressed amplitude spectrum SA'ki and the spectrum phase SPki, the IFFT is performed in step S6, and voice is synthesized by an overlapping addition. In step S7, it is determined whether or not the processes on all input frames have been completed. When it is determined that the processes on all input frames have not been completed, the processes in and after step S1 are repeated. If it is determined that the processes on all frames have been completed, the current process terminates.

Figure 5:
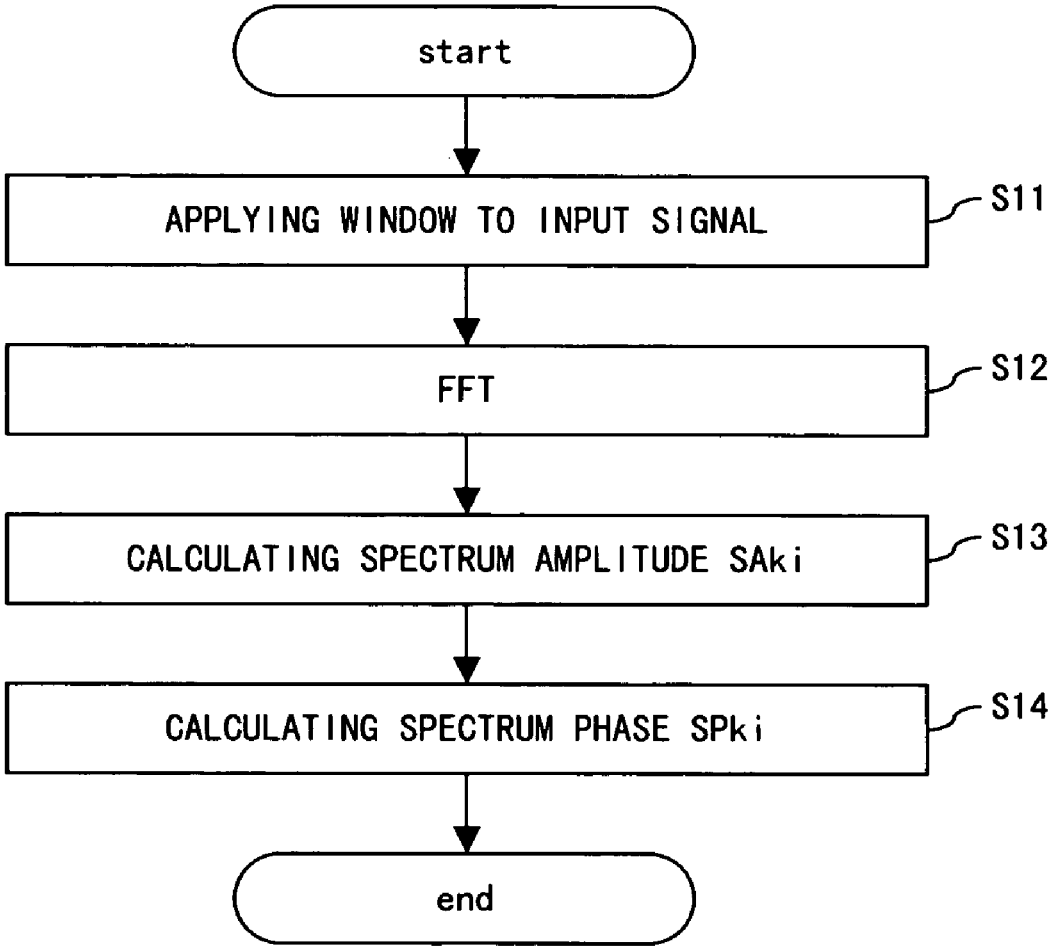
FIG. 5 is a detailed flowchart of the spectrum analyzing process.

FIG. 5 is a detailed flowchart of the process of the spectrum analysis in step S2 in FIG. 4. When the process is started as shown in FIG. 5, first in step S11, a window signal wkt is obtained by the next equation (2) using the window function Ht for the input signal xkt.

$$wkt=Ht\cdot xkt \quad t=0, \ldots, 2N-1 \tag{2}$$

Then, in step S12, the FFT process is performed on a window signal, and a real part XRki and an imaginary part XIki are obtained as a result. Then, in step S13, the spectrum amplitude SAki is obtained by the following equation (3).

$$SAki=(XRki^2+XIki^2)^{1/2} \quad 0\leqq i<N \tag{3}$$

Furthermore, in step S14, the spectrum phase SPki is calculated by the next equation (4), thereby terminating the process.

$$SPki=\tan^{-1}(XIki/XRki) \quad 0\leqq i<N \tag{4}$$

In the equations above, 2N indicates the number of points on the FFT, for example, 128 and 256, and the window function Ht is, for example, a Hamming window.

Figure 6:
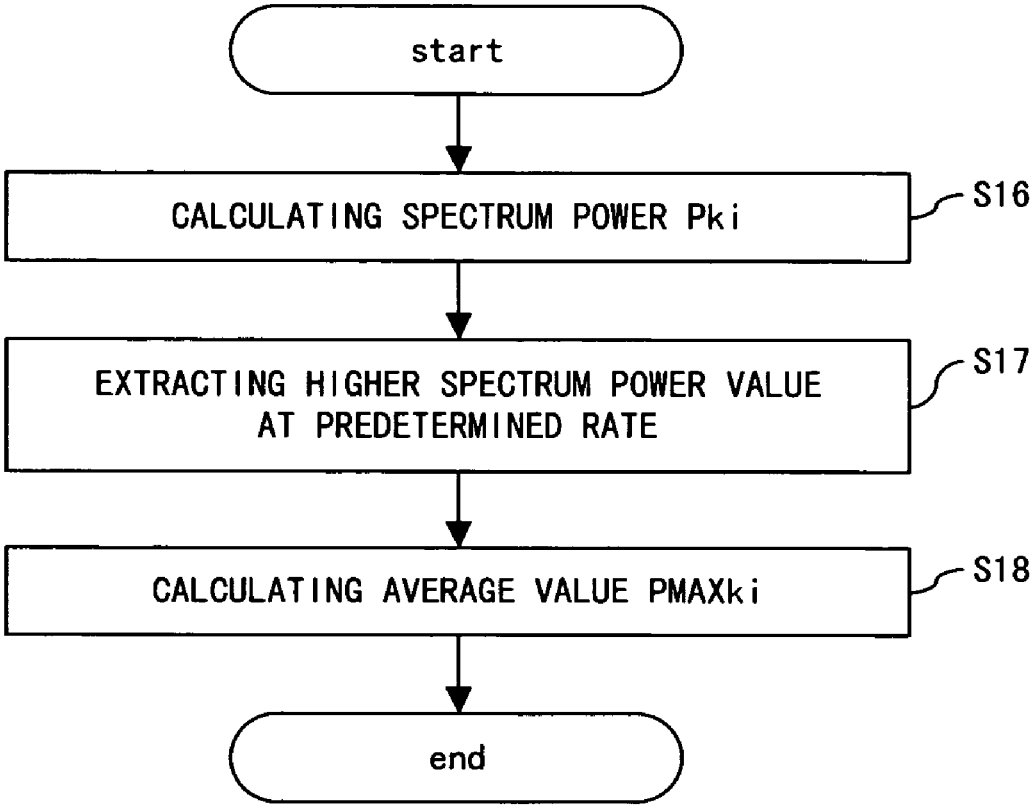
FIG. 6 is a detailed flowchart of the voice information estimating process.

FIG. 6 shows an embodiment of the voice information calculating process (step S3) shown in FIG. 4, in which the average value of the power indicating a predetermined ratio of the number of totalized samples from the largest power in a total number of samples in the power distribution of the pure voice is estimated as a voice information. If the process is started as shown in FIG. 6, first in step S16, the spectrum power Pki of the current frame to be currently processed is calculated by the next equation (5). That is, the square of the spectrum amplitude is obtained for each frequency (band) i in the k frame, and the result is calculated as spectrum power.

$$Pki=SAki^2 \quad 0\leqq i<N \tag{5}$$

Then, in step S17, in an arbitrary period, for example, corresponding to 100 frames in a monitoring period including the current frame, the distribution of the spectrum power is obtained for each frequency (band) index i using the calculated spectrum power. For example, the spectrum power for the higher 10%, that is, the value of 10 spectrum power, is extracted. In step S18, the higher 10%, that is, the average value PMAXki of the spectrum power at a predetermined higher rate, is calculated and output as the voice information to be output by the voice estimation unit 12, thereby terminating the process.

Figure 7:
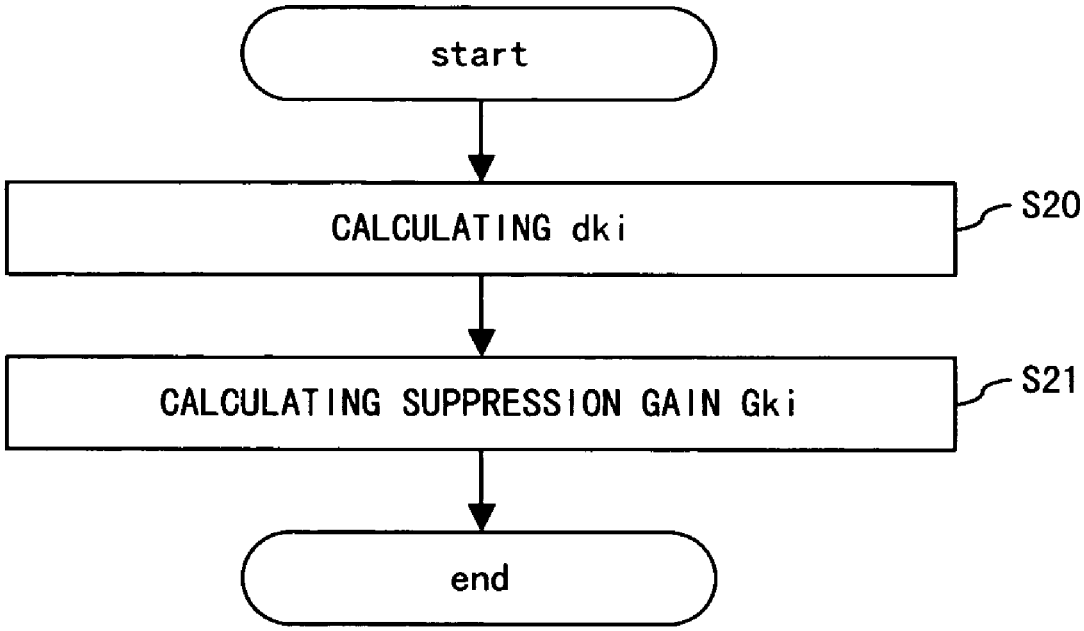
FIG. 7 is a detailed flowchart of the suppression gain calculating process.

FIG. 7 is a detailed flowchart of the suppression gain calculating process (step S4) shown in FIG. 4. In FIG. 7, when the process is started, the argument dki in the function f for determination of the suppression gain Gki is calculated by the following equation (6) in step S20.

$$dki=PMAXki-Pki \quad 0\leqq i<N \tag{6}$$

Then, in step S21, the suppression gain Gki is calculated using the next equation (7), thereby terminating the process.

$$Gki=f(dki) \quad 0\leqq i<N \tag{7}$$

Figure 8:
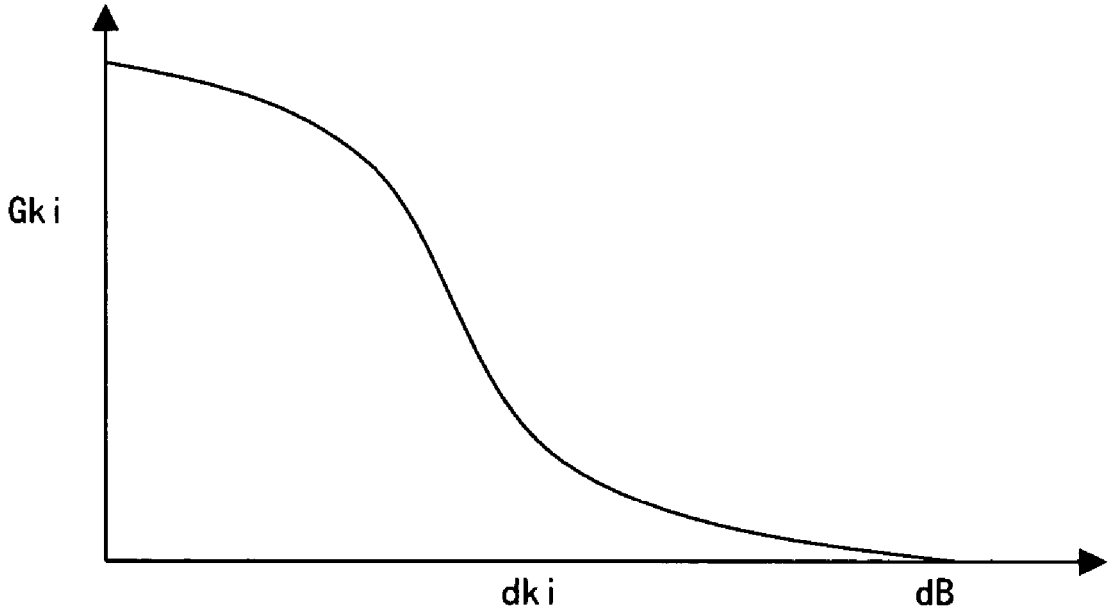
FIG. 8 shows an example of a suppression gain calculation function.

FIG. 8 shows an example of a suppression gain calculation function f. The function f determines the suppression gain corresponding to the position of the distribution of the voice power, and can be empirically obtained from the balance between the voice suppression and the noise reduction effect. In FIG. 8, the actual suppression is reduced such that the smaller the argument dki of the function f, the larger the suppression gain Gki, and the actual suppression is increased such that the larger the argument dki, the smaller the suppression gain.

Figure 9:
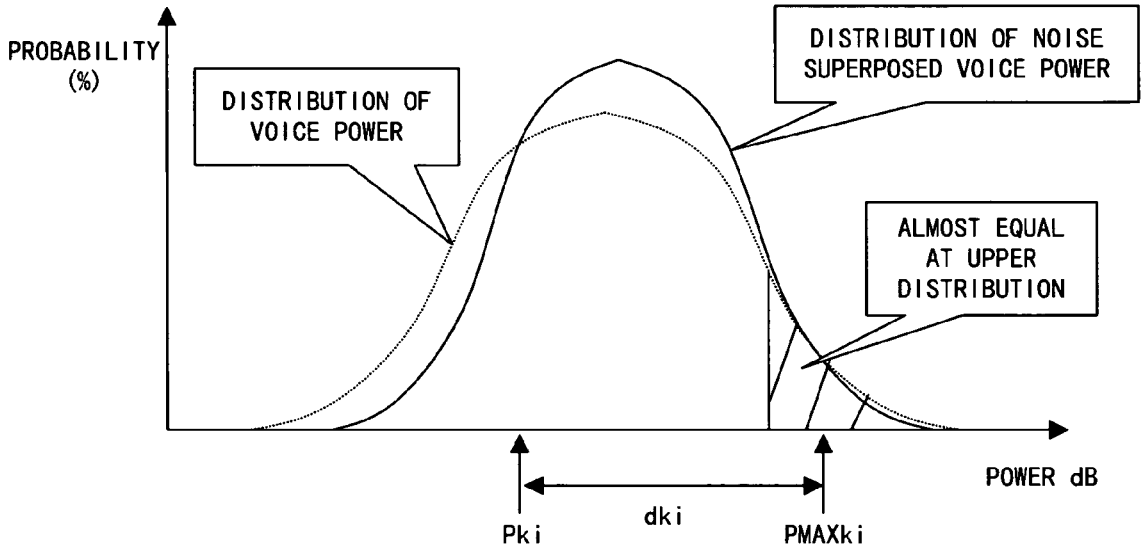
FIG. 9 is an explanatory view of the voice power distribution for explanation of an example of the suppression gain calculation function shown in FIG. 8.

FIG. 9 is an explanatory view of the reason for the larger suppression gain Gki in the small range of the argument dki of the suppression gain calculation function f. Normally, the input voice signal is a noise superposed signal, and contains the pure voice element and the noise element. When the power of the pure voice element is larger than that of the noise element on an average, the pure voice power can be approximated by the input signal power in the interval where the power of the noise superposed input signal is large. Therefore, when the difference between the input signal power Pki of the current frame and the power average value PMAXki of a higher voice power at a predetermined rate, for example, within 10% obtained corresponding to the 100 frames is small, the pure voice power contained in the noise superposed voice signal is large, and the influence of the noise element is considered to be small. Therefore, it is appropriate to have a larger suppression gain, that is, to have smaller suppression. Furthermore, an actual input signal, that is, not a noise superposed voice signal but the actual width of the pure voice power, is empirically calculated or the distribution is assumed, thereby the distribution of the pure voice power indicated by dotted lines shown in FIG. 9 can be estimated. The dki can also be calculated from the difference between the power average value PMAXki and the input signal power Pki of the current frame.

Figure 10:
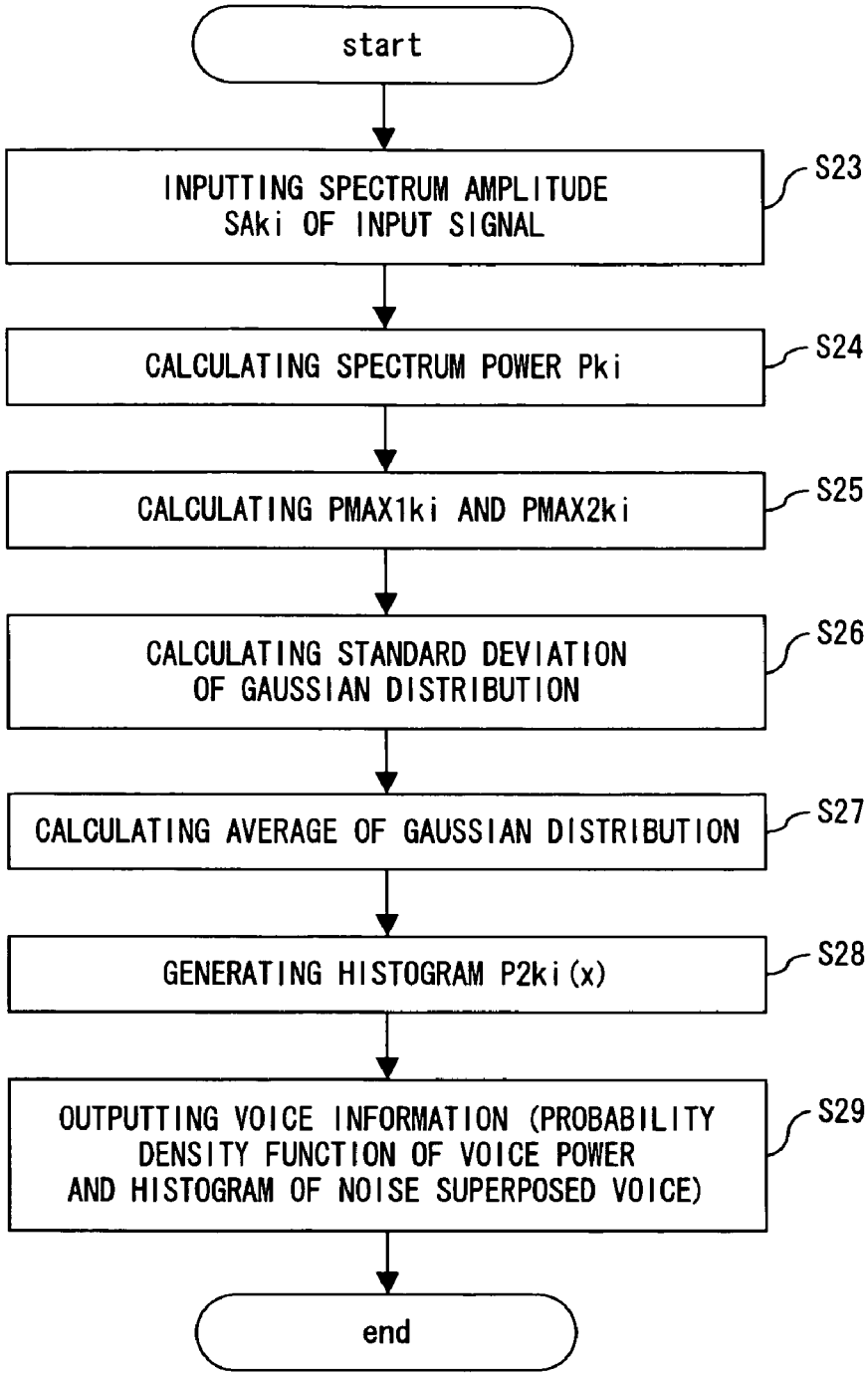
FIG. 10 is a flowchart of another embodiment of the voice information estimating process.

Another embodiment of the voice information calculating process in step S3 shown in FIG. 4 and the corresponding suppression gain calculating process in step S4 are described below by referring to FIGS. 10 through 12. FIG. 10 is a flowchart of another embodiment of the voice information calculating process. In FIG. 10, when the process starts, the spectrum amplitude SAki obtained by the equation (3) is input in step S23, and the spectrum power Pki is calculated for each frequency (band) i by the equation (5).

Then, in step S25, as in FIG. 6, the two average spectrum power values PMAX1*ki* and PMAX2*ki* respectively at a predetermined higher rate of the spectrum power of the noise superposed voice signal are calculated. For example, PMAX1*ki* is calculated, as described above, such that it indicates the average value of the power at a higher x1% (corresponding to the position of a1σ in the Gaussian distribution) of the spectrum power indicated by the index i of the frequency corresponding to the 100 frames, and PMAX2*ki* is calculated such that it indicates the average value of the power at a higher x2% (corresponding to the position of a2σ in the Gaussian distribution). It is assumed, for example, that a1 is larger than a2, and σ indicates the standard deviation.

Then, in step S26, the distribution of the pure voice power for each index i of the frequency is assumed to be the Gaussian distribution, and the standard deviation of the Gaussian distribution is calculated by the equation (8).

$$\sigma ki=(P\mathrm{MAX}1ki-P\mathrm{MAX}2ki)/(a1-a2)\quad 0\leqq i<N \tag{8}$$

Then, in step S27, the average m of the Gaussian distribution is calculated by the equation (9).

$$mki=P\mathrm{MAX}1ki-a1\cdot\sigma ki\quad 0\leqq i<N \tag{9}$$

Thus, based on the standard deviation and the average for the pure voice power, the probability density function of the voice power can be obtained by the following equation (10). In the equation, x indicates the pure voice power.

$$P1ki(x)=\{1/(2\pi)^{1/2}\}\exp[-(x-mki)^2/2\ \sigma ki^2]\quad 0\leqq i<N \tag{10}$$

In this example, it is assumed that the power distribution of the pure voice is the Gaussian distribution, but the probability density function can also be obtained by calculating the histogram of the pure voice power.

Then, in step S28 shown in FIG. 10, the spectrum power of the noise superposed input signal is monitored and the histogram P2*ki*(x) is generated, and in step S29, the probability density function P1*ki*(x) of the pure voice power and the histogram P2*ki*(x) of the noise superposed voice power are output as the voice information, thereby terminating the process.

The practical example of calculating PMAX1*ki* and PMAX2*ki* in step S25 is described below further in detail. Assume that the value of the above-mentioned a1 is 3, and the value of a2 is 2, and the PMAX1*ki* is calculated such that it indicates the power value at a higher 0.3%, and the PMAX2*ki* is calculated such that it indicates the power value at a higher 4.6%.

That is, in calculating PMAX1*ki*, for example, the spectrum power of the past 1000 frames is arranged in order from the highest level, and the highest 6 levels are selected. That is, the power at a higher 0.6% is selected, and the average value of the selected spectrum power is obtained. In calculating PMAX2*ki*, for example, the spectrum power of the past 1000 frames is arranged in order from the highest level, and the highest 92 levels are selected. That is, the power at a higher 9.2% is selected, and the average value of the selected spectrum power is obtained.

Figure 11:
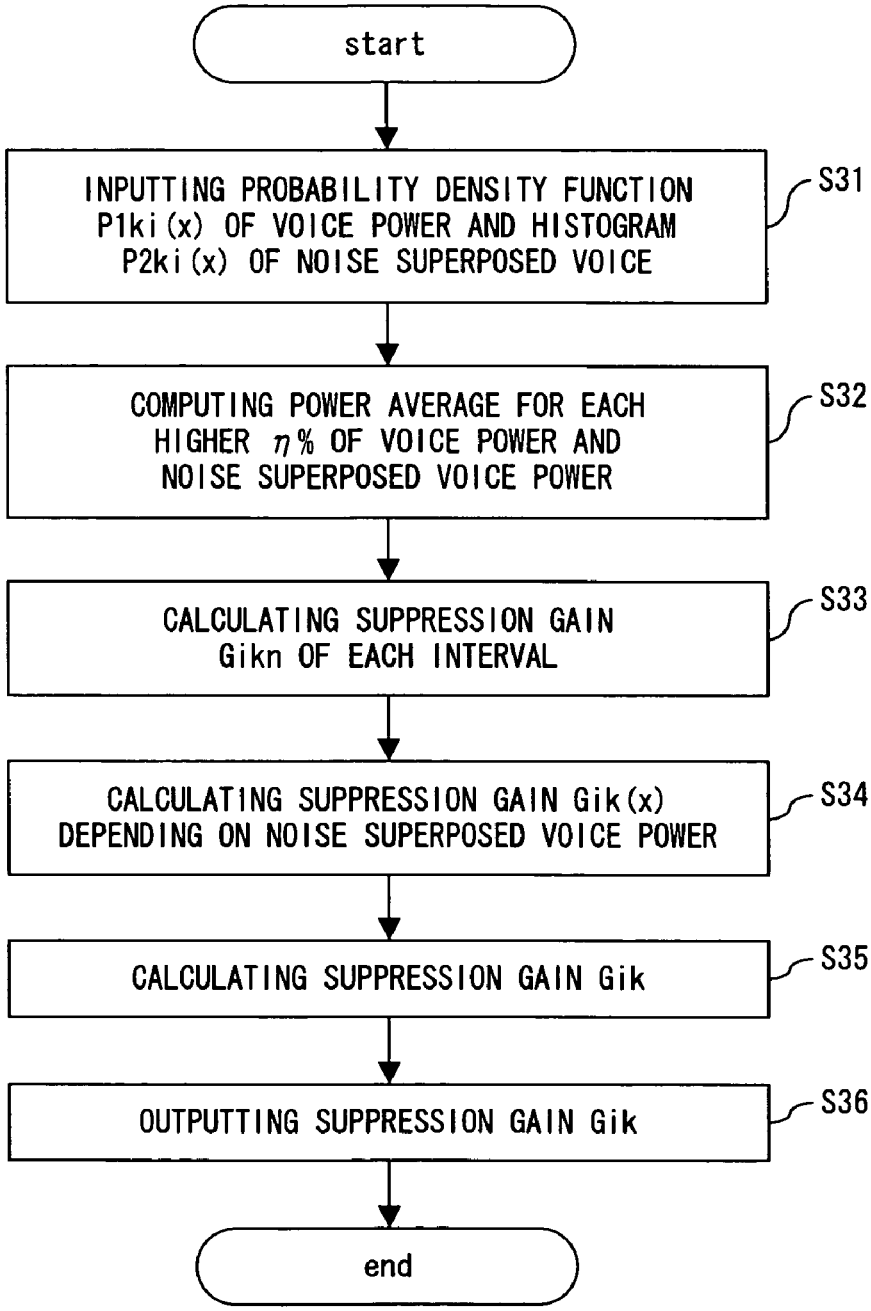
FIG. 11 is a flowchart of the suppression gain calculating process corresponding to the voice information estimating process shown in FIG. 10.

FIG. 11 is a detailed flowchart of the suppression gain calculating process corresponding to the voice information calculating process shown in FIG. 10. In FIG. 11, when the process starts, the probability density function P1*ki*(x) of the pure voice power and the histogram P2*ki*(x) of the noise superposed voice signal output in the process shown in FIG. 10 are input in step S31, and in step S32, the distribution is segmented at each higher η % in the distribution of the (pure) voice power and the noise superposed voice power, and the average value of the power is calculated for each segment.

Figure 12:
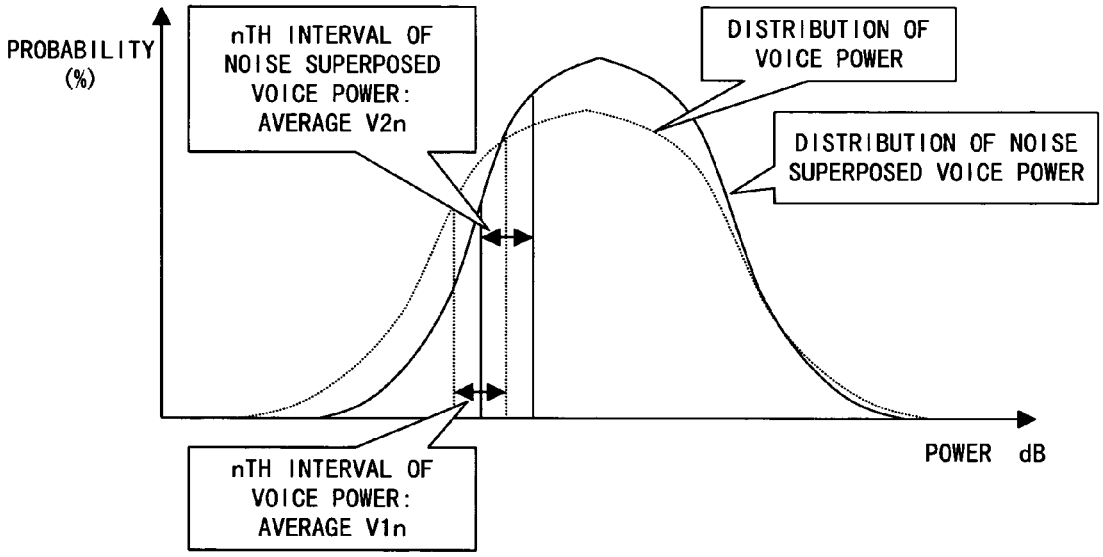
FIG. 12 is an explanatory view of the voice power distribution for explanation of the suppression gain calculating process shown in FIG. 10.

FIG. 12 is an explanatory view of the process. For example, in the distribution of the noise superposed voice power, the case in which the average value of the power of a higher 10% is calculated using the past 100 frames is described below as an example. The pure voice power can be similarly calculated using a voice signal including no noise originally.

First, the noise superposed voice power of the past 100 frames is arranged in order from the highest level, and the average value V2*n* of the noise superposed voice power of a higher 10 levels is calculated. That is, the average value of the highest 10 noise superposed voice power is assumed to be $V2_1$, the second highest 10 noise superposed voice power from the eleventh level is assumed to be $V2_2$, . . . , and the average value of ten noise superposed voice power from the 91st level is assumed to be $V2_{10}$. The average value of the pure voice power can also be obtained for the nth interval as $V1_n$.

In step S33 shown in FIG. 11, the suppression gain Gikn for each interval can be calculated. In this process, in the distribution of the pure voice power and the distribution of the noise superposed voice power, the noise superposed voice power is assumed to be obtained by superposing the noise on the (pure) voice power in the corresponding interval. The suppression gain for the average value V2*n* corresponding to the nth interval of the noise superposed voice power is assumed to be obtained by the equation (13) using the following equations (11) and (12).

$$V1n = 10\log_{10}(\text{voice power}) \tag{11}$$

$$V2n = 10\log_{10}(\text{voice power} + \text{noise power}) \tag{12}$$

$$Gikn = \left(10\frac{V2n - V1n}{10}\right)^{\frac{1}{2}} \tag{13}$$

The suppression gain Gikn obtained in step S33 is a discrete value obtained for each interval, Gikn is interpolated by the following equation (14) in step S34 to calculate the suppression gain as a function of the actual noise superposed voice power signal x, and a suppression gain function is calculated.

$$Gik(x) = \frac{Gikn - Gik(n-1)}{V2n - V2(n-1)}\{x - V2(n-1)\} \tag{14}$$

where V2 (n−1) indicates the value of V2 in the (n−1)th interval.

Then, in step S35, the value of the suppression gain Gik(x) is calculated using the value of the noise superposed voice power x of the current frame, and the value is output in step S36 and the process terminates.

Figure 13:
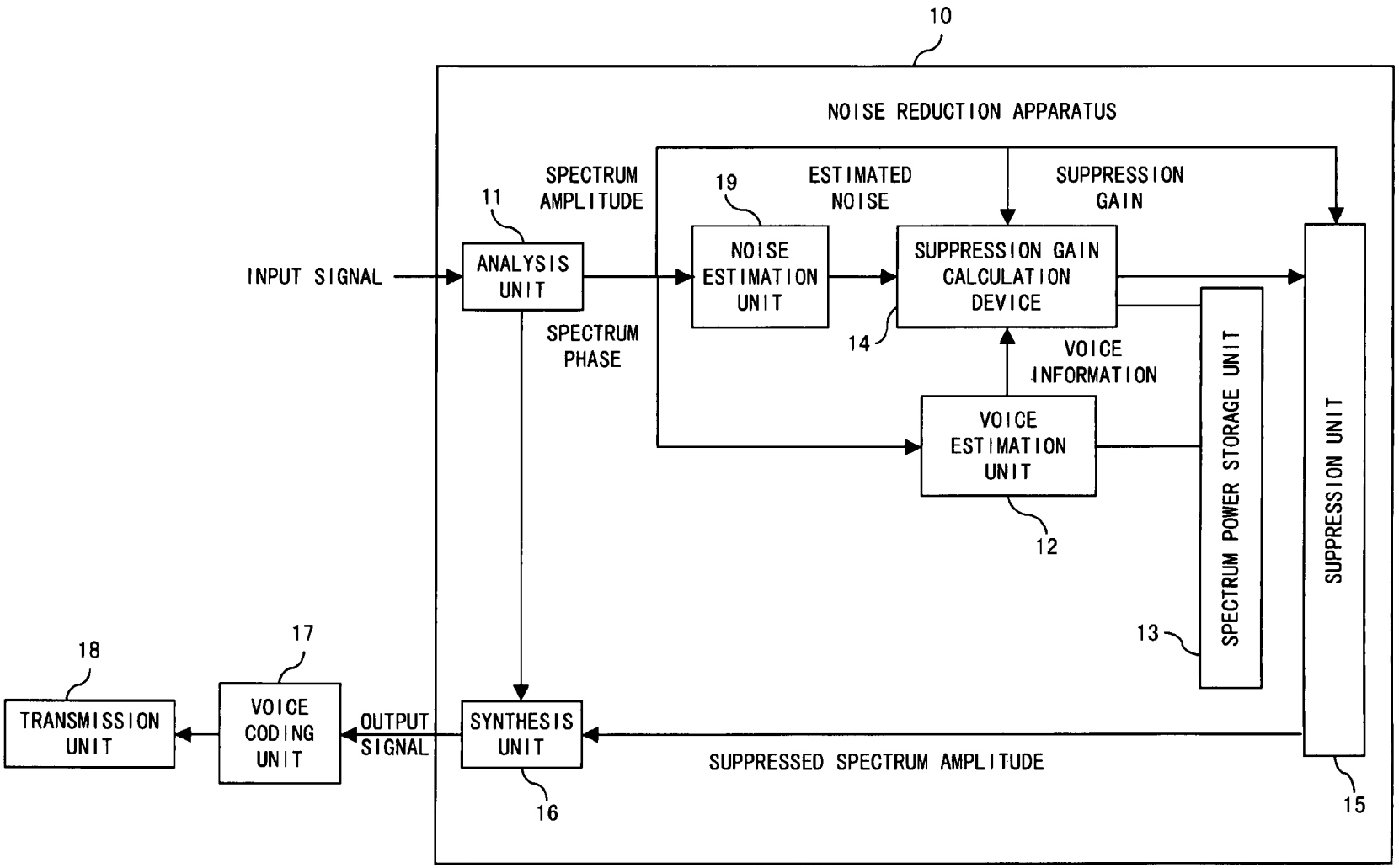
FIG. 13 is a block diagram showing the configuration of the noise reduction apparatus according to the second embodiment of the present invention.

The second embodiment of the present invention is described below. FIG. 13 is a block diagram of the configuration of the noise reduction apparatus according to the second embodiment. The differences shown in FIG. 13 compared with FIG. 3 showing the configuration according to the first embodiment are that a noise estimation unit 19 is added, and the suppression gain calculation device 14 calculates the suppression gain using estimated noise as the output of the noise estimation unit 19 in addition to the voice information output by the voice estimation unit 12. The noise estimation unit 19 estimates the spectrum noise (=noise spectrum) contained in an input signal using the spectrum amplitude output by the analysis unit 11, and can also estimate the noise using the input signal on the time axis instead of the spectrum amplitude.

Figure 14:
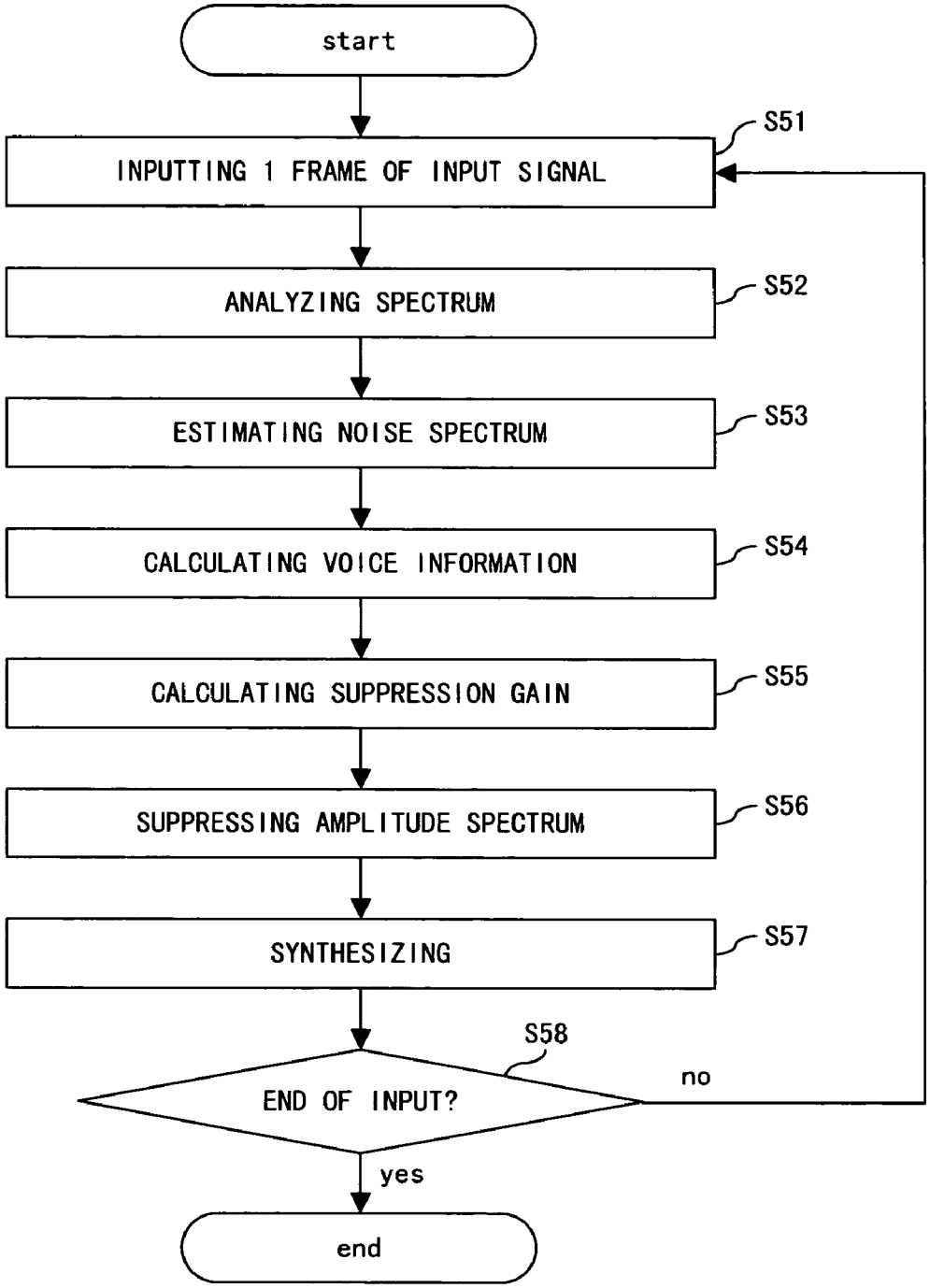
FIG. 14 is a flowchart of the entire noise reducing process according to the second embodiment of the present invention.

FIG. 14 is a flowchart of the entire noise reducing process according to the second embodiment of the present invention. The differences shown in FIG. 14 compared with showing the case according to the first embodiment are that the spectrum noise is estimated in step S53, and the voice information is calculated corresponding to the estimation result in step S54, and the suppression gain is calculated in step S55.

Figure 15:
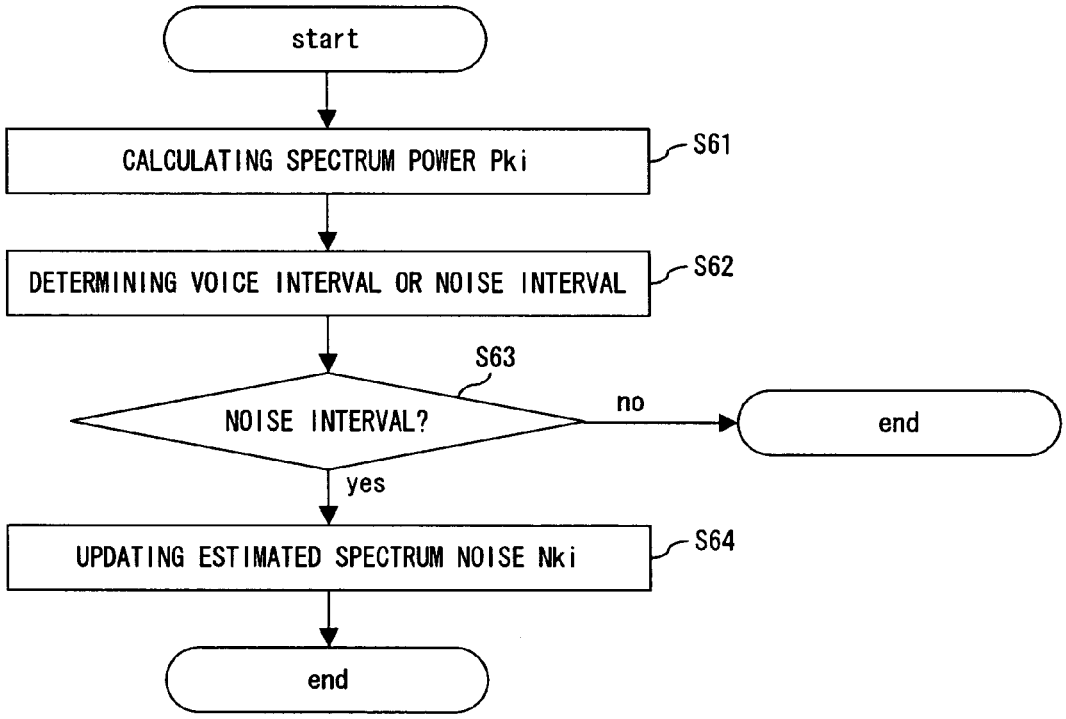
FIG. 15 is a detailed flowchart of the noise estimating process according to the second embodiment of the present invention.

FIG. 15 is a detailed flowchart of the spectrum noise reducing process in step S53 shown in FIG. 14. When the process starts as shown in FIG. 15, the spectrum power Pki is calculated by the equation (5) in step S61, and the process determining whether it is the voice interval or the noise interval is performed in step S62. The well-known conventional technology can be used in the determination, for example, the method of monitoring the difference between an average frame power for a long period and the power of the current frame, the method of calculating a correlation coefficient, etc. can be used.

If it is determined in step S63 that it is not a noise interval, the process on the frame terminates. If it is a noise interval, then the estimated spectrum noise Nki is updated in step S64.

In this updating process, the spectrum power (noise spectrum power) of the current frame (noise frame) and the calculated past noise spectrum power are multiplied by the respective contribution rates to update the noise spectrum power. Thus, the high frequency element of the power fluctuation for each frame can be eliminated. In this example, the estimated spectrum noise is updated by the following equation (15) where ξ indicates a constant corresponding to the above-mentioned contribution rate.

$$Nki = \xi \cdot Pki + (1-\xi)N(k-1)i \quad 0 \leqq i < N \tag{15}$$

where N(k−1) indicates the noise spectrum power of the ith band of the (k−1)th frame.

Figure 16:
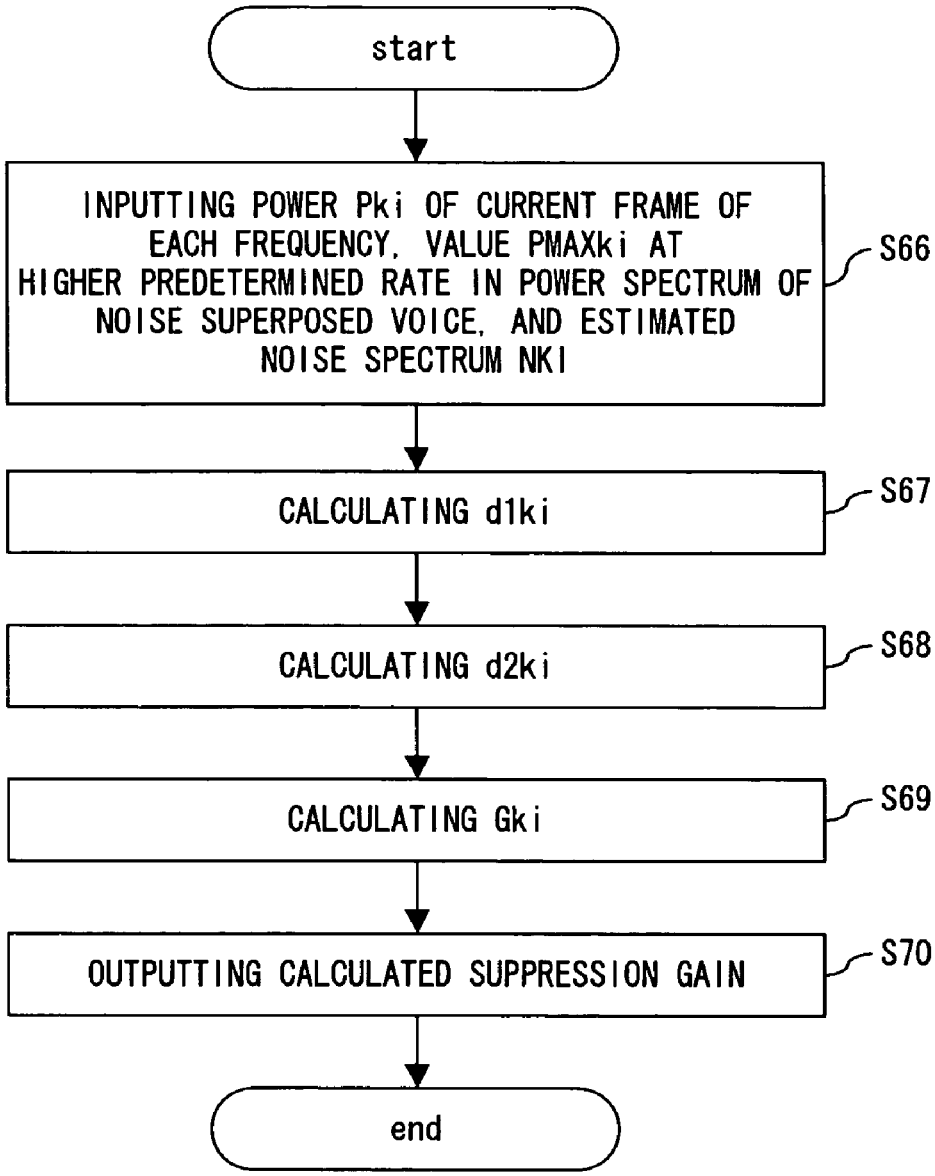
FIG. 16 is a detailed flowchart of the suppression gain calculating process according to the second embodiment of the present invention.

FIG. 16 is a detailed flowchart of the suppression gain calculating process in step S55 shown in FIG. 14. The voice information calculating process in step S54 is performed, for example, as shown in FIG. 6 in the first embodiment.

When the process starts as shown in FIG. 16, first in step S66, the power Pki of the current frame for each frequency (band) and the spectrum power average value PMAXki at a predetermined higher rate in the spectrum power of the noise superposed voice signal, that is, the voice information output by the voice estimation unit 12, and the estimated noise spectrum Nki, that is, the output of the noise estimation unit 19, are input, d1*ki* is calculated by the following equation (16) in step S67, d2*ki* is calculated by the equation (17) in step S68, the suppression gain Gki is calculated by the following equation (18) in step S69, and the calculated suppression gain is output in step S70, thereby terminating the process.

$$d1ki = PMAXki - Pki \quad 0 \leqq i < N \tag{16}$$

$$d2ki = PMAXki - Nki \quad 0 \leqq i < N \tag{17}$$

$$Gki = g(d1ki, d2ki) \quad 0 \leqq i < N \tag{18}$$

Figure 17:
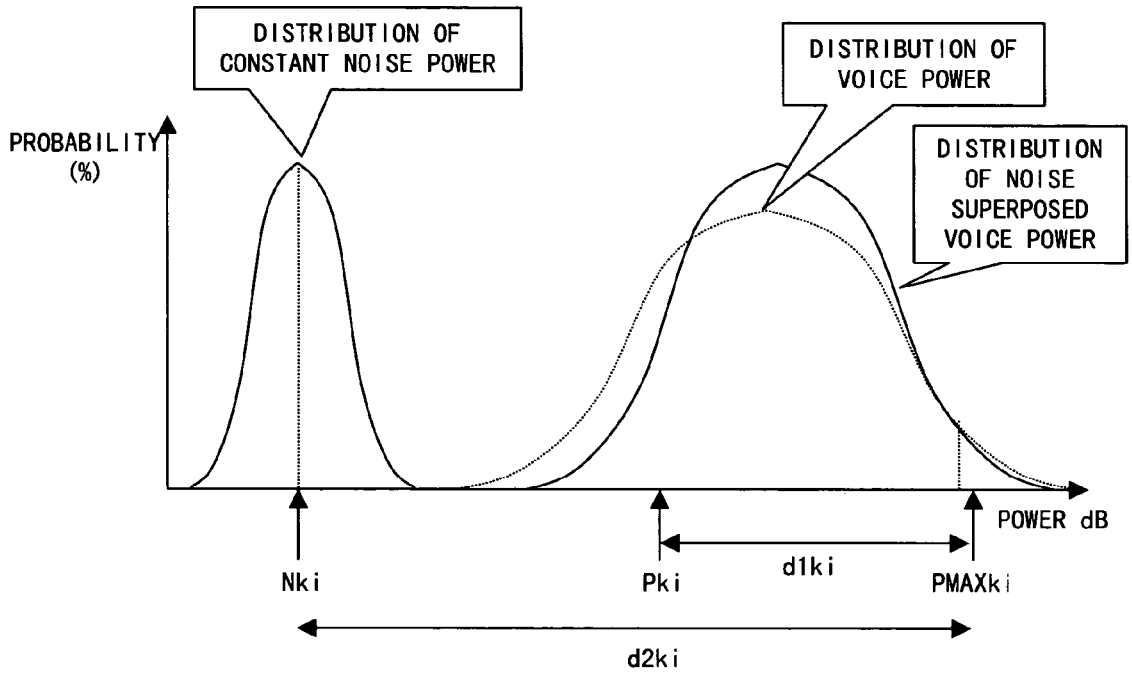
FIG. 17 is an explanatory view of the power distribution for explanation of the suppression gain calculating process shown in FIG. 16.

FIG. 17 is an explanatory view of d1*ki* and d2*ki* as the argument of the function g provided by the equation (18). In FIG. 17, the difference d1*ki* between the average value PMAXki of the power spectrum at a higher predetermined rate of the noise superposed voice power and the current frame power Pki corresponds to the level of the pure voice power contained in the current frame, and the difference d2*ki* between the PMAXki and the power Nki of the estimated spectrum of the constant noise corresponds to the distance between the distribution of the noise superposed voice power and the distribution of the constant noise power. The peak position is applied to distribution of the constant noise power, but it is not applied to the distribution of the noise superposed voice power. In this example, the d2*ki* is defined as indicating the distance of the distribution of two power levels.

In the present embodiment, the suppression gain is determined with the pure voice power information and the noise power information taken into account using two values of d1*ki* and d2*ki*. That is, the larger the value of d1*ki*, the smaller the pure voice power, thereby reducing the suppression gain. In addition the larger the d2*ki*, the more discrete the distribution of the noise superposed voice power and the distribution of the constant noise power, thereby reducing the contained noise power and increasing the suppression gain. For display, using the equation (19), the function g for providing the suppression gain Gki is set.

$$g(d1ki, d2ki) = \tau - \kappa \cdot d1ki + \mu \cdot d2ki \quad 0 \leqq i < N \tag{19}$$

where τ, κ, and μ are positive coefficients.

Figure 18:
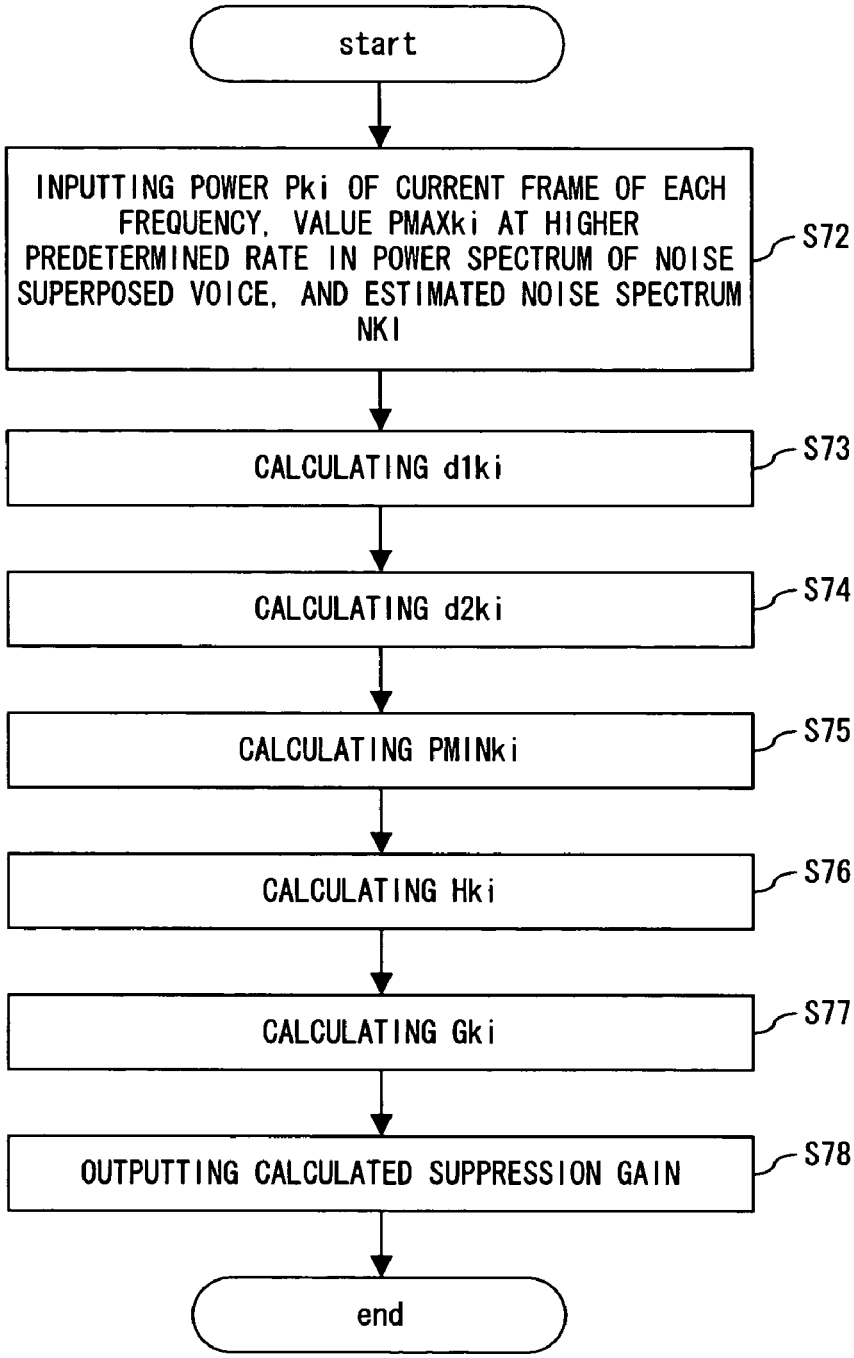
FIG. 18 is a detailed flowchart of another embodiment of the suppression gain calculating process.

FIG. 18 is a flowchart according to another embodiment of the suppression gain calculating process according to the second embodiment of the present invention. When the process starts as shown in FIG. 18, first in step S72, as in step S66 shown in FIG. 16, Pki, PMAXki, and Nki are input, and d1*ki* and d2*ki* are calculated respectively in steps S73 and S74, and the calculating process of the lower limit PMINki of the pure voice power is performed in step S75.

Figure 19:
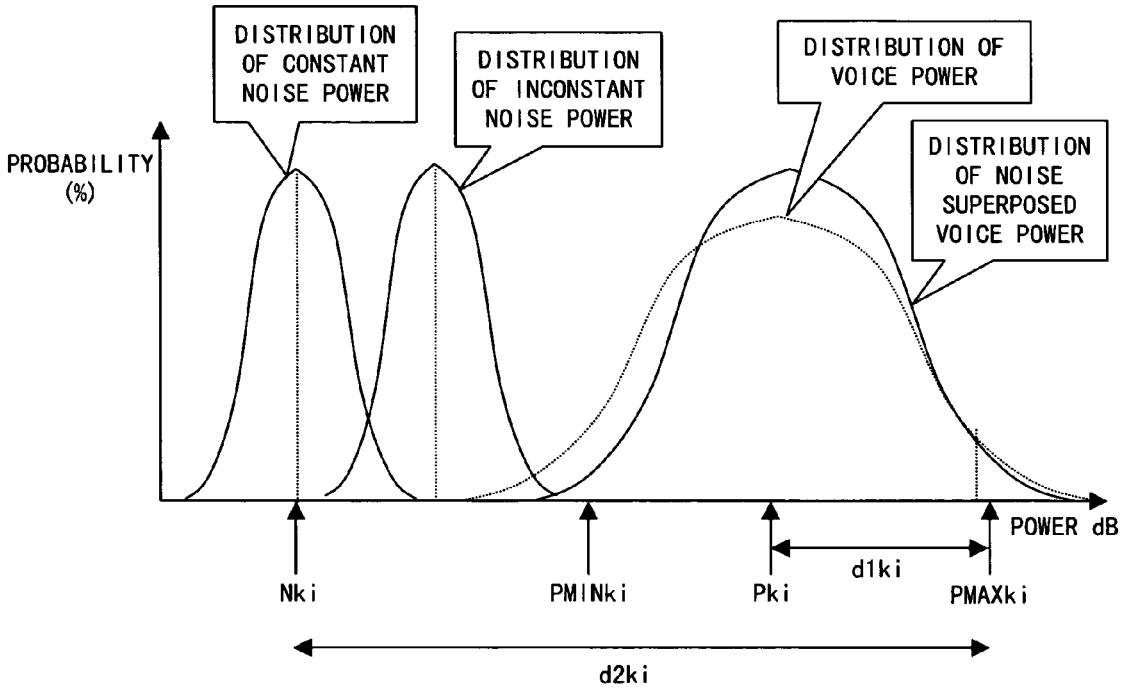
FIG. 19 is an explanatory view of the power distribution in the suppression gain calculating process shown in FIG. 18.

FIG. 19 is an explanatory view of the suppression gain calculating process. In FIG. 19, the position of the lower limit in the distribution of the pure voice power is estimated by the following equation (20) as the value of PMINki.

$$PMINki=PMAXki-\phi ki \quad 0\leqq i<N \tag{20}$$

In the equation (20), if the input level is constant, it is assumed that the actual width (difference between the largest and smallest power) $\phi$ki of the pure voice power is assumed to be constant. The value of the actual width can be checked from the distribution of the pure voice power in advance, or can be calculated by assuming the distribution of the pure voice power as the Gaussian distribution, and multiplying the standard deviation $\sigma$ obtained by observing the power of an input signal by a constant.

Then, in step S76 shown in FIG. 18, the frequency Hki of the inconstant noise is calculated. In this process, the sum of the Nki indicating the position of the distribution of the constant noise shown in FIG. 19 and the $\lambda$ as the value indicating the width of the power in the noise detected interval is obtained, and the frequency is checked as to whether or not inconstant noise is contained in each frame depending on whether or not Pki corresponding to the current frame is located between Nki+$\lambda$ and the lower limit PMINki in the distribution of the pure voice power. That is, it is checked in each frame whether or not each frame contains inconstant noise such as bubble noise, and the frequency Hki is updated by the following equation (21) or (22) corresponding to the input frame.

$$Hki=f\{H(k-1)i\cdot(k-1)\}+1]/k \quad Nki+\lambda\leqq Pki\leqq PMINki \tag{21}$$

$$Hki=\{H(k-1)i\cdot(k-1)\}/k \quad Pki<Nki+\lambda,\ PMINki<Pki \tag{22}$$

where H(k−1) indicates the frequency for the preceding frame $0\leqq i<N$

That is, Nki+$\lambda$ indicates the upper limit power of the noise, and frequency Hki of the inconstant noise can be calculated depending on the ratio of the frames having Pki between the upper limit value and the lower limit value PMINki of the distribution of the pure voice power to the total input frames.

Then, in step S77 shown in FIG. 18, the suppression gain Gki is calculated by the following equation (23), and the suppression gain is output in step S78, thereby terminating the process.

$$Gki=h(d1ki,d2ki,Hki) \quad 0\leqq i<N \tag{23}$$

The function h in the equation (23) for calculation of the suppression gain Gki can be determined by, for example, the following equation (24).

$$h(d1ki,d2ki,Hki)=\tau-\kappa\cdot d1k1+\mu\cdot d2ki-\nu\cdot Hki \quad 0\leqq i<N \tag{24}$$

where $\tau$, $\kappa$, $\mu$, and $\nu$ are positive coefficients.

In FIG. 19, as shown in FIG. 17, the larger the d1*ki* is, the smaller the pure voice power becomes. Therefore, the function h is set such that the suppression gain can be reduced. In addition, the larger the d2*ki*, the smaller the noise power. Therefore, the function h is set such that the suppression gain can be larger. Furthermore, since the larger the frequency Hki of the inconstant noise, the more the inconstant noise exists. Therefore, the function h is set such that the suppression gain can be reduced.

Figure 20:
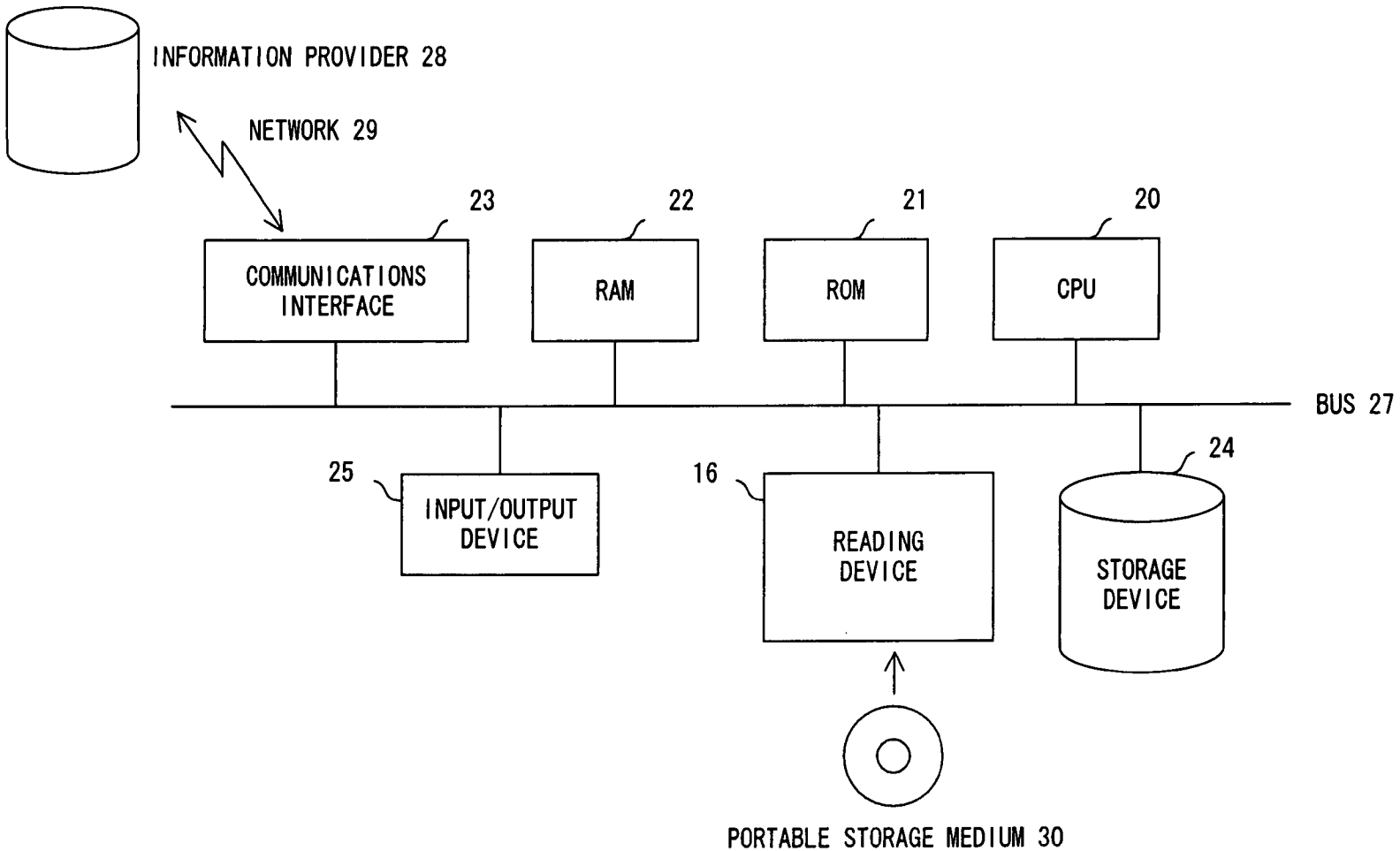
FIG. 20 is an explanatory view showing the loading a program into a computer to realize the present invention.

The noise reduction apparatus and noise reducing method according to the present invention have been described above, but the noise reduction apparatus can also be configured as a processor and a common computer system. FIG. 20 is a block diagram of the configuration of a computer system, that is, the hardware environment.

In FIG. 20, the computer system is configured by a central processing unit (CPU) 20, read only memory (ROM) 21, random access memory (RAM) 22, a communications interface 23, a storage device 24, an input/output device 25, a reading device 26 of a portable storage medium, and a bus 27 to which the above-mentioned components are connected.

The storage device 24 can be various types of storage devices such as a hard disk, magnetic disk, etc. These storage devices 24 or ROM 21 store a program, etc. shown in the flowcharts in FIGS. 4 through 7, 10, 11, 14 through 16, and 18, and the program is executed by the CPU 20, thereby estimating the information about pure voice, suppressing noise corresponding to the information, etc.

The program can also be stored in the storage device 24 from a program provider 28 through a network 29 and the communications interface 23, or can be marketed, stored in a commonly distributed portable storage medium 30, set in the reading device 26, and can be executed by the CPU 20. The portable storage medium 30 can be various types of storage media such as a CD-ROM, a flexible disk, an optical disk, a magneto-optical disk, etc., and the program stored in the storage media is read by the reading device 26 and realizes the suppression of various types of noise including the bubble noise according to the embodiments of the present invention, etc.

What is claimed is:

1. A noise reduction apparatus, implemented by a computer system, having an analysis unit for analyzing a frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area, comprising:

a voice information estimation device to estimate as voice information, using output of the analysis unit, information for use as basic information in calculating a suppression gain of a signal, which is information corresponding to at least pure voice element excluding a noise element in an input voice signal; and a suppression gain calculation device to calculate the suppression gain based on output of said voice information estimation device and the analysis unit, and providing a calculation result for the suppression unit; wherein the voice information estimation device estimates an average power value, as a voice signal, indicating the number of samples totalized from a largest power as a predetermined ratio of a number of samples in a power distribution in each frequency of pure voice for a plurality of input voice signal frames, and a power Pki of a current frame for each frequency and a spectrum power average value PMAXki at a predetermined higher rate in a spectrum power of a noise superposed voice signal, that is, a voice information output by the voice information estimation device are used to calculate the suppression gain Gki as follows:

$$dki=PMAXki-Pki \quad 0\leqq i<N$$

$$Gki=f(dki) \quad 0\leqq i<N.$$

2. The apparatus according to claim 1, wherein said voice information estimation device estimates power of pure voice element excluding the noise element.

3. The apparatus according to claim 1, wherein said suppression gain calculation device calculates a suppression gain corresponding to a frame k based on a difference between the power average value PMAXki corresponding to a frequency index i of the frame currently to be processed and a spectrum power Pki corresponding to the frame k.

4. The apparatus according to claim 1, wherein said voice information estimation device calculates power distribution of a noise superposed voice signal as the input voice signal, as the information for use in calculating the suppression, in addition to the estimated value of the power distribution of the pure voice as the information corresponding to the pure voice element, and provides a calculation result for the suppression gain calculation device.

5. The apparatus according to claim 4, wherein said voice information estimation device estimates a probability density function corresponding to the power distribution of the pure voice using two average values of power indicating the number of samples totalized from the largest power in a predetermined ratio of the total number of samples in the power distribution in each frequency of pure voice for a plurality of input voice signal frames.

6. The apparatus according to claim 4, wherein said suppression gain calculation device divides power distribution into a plurality of intervals such that a number of samples totalized from largest power can be a predetermined ratio of the total samples for each of the distribution of the pure voice power and the power distribution of the noise superposed voice signal as the output of the voice information estimation device, and obtains the suppression gain based on the average value of the power in each of the plurality of intervals.

7. A noise reduction apparatus having an analysis unit for analyzing the frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area, comprising:

a noise estimation device to estimate the spectrum of a noise element in the input voice signal;

a voice information estimation device to estimate, using output of the analysis unit, the information for use as basic information in calculating a suppression gain of a signal, which is the information corresponding to at least the pure voice element excluding a noise element in the input voice signal; and a suppression gain calculation device to calculate the suppression gain based on the output of the noise estimation device, the voice information estimation device, and the analysis unit, and providing a calculation result for the suppression unit; wherein the voice information device estimates an average power value, as a voice signal, indicating the number of samples totalized from a largest power as a predetermined ratio of a number of samples in a power distribution in each frequency of pure voice for a plurality of input voice signal frames, and a power Pki of a current frame for each frequency and a spectrum power average value PMAXki at a predetermined higher rate in a spectrum power of a noise superposed voice signal, that is, a voice information output by the voice information estimation device, and an estimated noise spectrum Nki, that is, an output of the noise estimation device, are used to calculate the suppression gain Gki as follows:

$$d1ki = PMAXki - Pki \quad 0 \leq i < N$$

$$d2ki = PMAXki - Nki \quad 0 \leq i < N$$

$$Gki = g(d1ki, d2ki) \quad 0 \leq i < N$$

$$g(d1ki, d2ki) = \tau - \kappa \cdot d1ki + \mu \cdot d2ki \quad 0 \leq i < N$$

wherein, τ, κ, and μ are positive coefficients.

8. The apparatus according to claim 7, wherein said voice information estimation device estimates power of pure voice element excluding the noise element.

9. The apparatus according to claim 7, wherein said suppression gain calculation device calculates a suppression gain based on a difference between PMAXki and Pki, and a difference between PMAXki and Nki in response to input of the power average value PMAXki corresponding to frequency index i of a frame k to be currently processed, spectrum noise Nki for a current frame as output of said noise estimation device, and power Pki of a current frame.

10. The apparatus according to claim 7, wherein said suppression gain calculation device estimates a lower limit of pure voice power, calculates a frequency at which inconstant noise is detected in a plurality of voice frame signals previously input including a current frame based on the estimation result, and calculates a suppression gain based on a difference between PMAXki and Pki, a difference between PMAXki and Nki, and a calculated frequency in response to input of the power average value PMAXki corresponding to a frequency index i of a frame k to be currently processed, spectrum power Pki corresponding to the frame k, and spectrum noise Nki corresponding to a current frame as output of said noise estimation device.

11. A noise reducing method for reducing noise using an analysis unit for analyzing a frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency area, performing:

estimating, using output of the analysis unit, the information for use as basic information in calculating a suppression gain of a signal, which is the information corresponding to at least the pure voice element excluding a noise element in the input voice signal;

calculating the suppression gain based on the estimated voice information and the output of the analysis unit, and providing a calculation result for the suppression unit; and estimating an average power value, as a voice signal, indicating a number of samples totalized from a largest power as a predetermined ratio of a number of samples in a power distribution in each frequency of pure voice for a plurality of input voice signal frames in estimating the voice information, and a power Pki of a current frame for each frequency and a spectrum power average value PMAXki at a predetermined higher rate in a spectrum power of a noise superposed voice signal are used to calculate the suppression gain Gki as follows:

$$dki = PMAXki - Pki \quad 0 \leq i < N$$

$$Gki = f(dki) \quad 0 \leq i \leq N$$

12. A noise reducing method for reducing noise using an analysis unit for analyzing the frequency of an input voice signal and converting the signal into a signal of a frequency area, a suppression unit for suppressing the signal of the frequency area, and a synthesis unit for synthesizing and outputting a suppressed signal of a time area using the suppressed signal of the frequency are, comprising:

estimating the spectrum of a noise element in the input voice signal;

estimating, using output of the analysis unit, the information for use as basic information in calculating a suppression gain of a signal, which is the information corresponding to at least the pure voice element excluding a noise element in the input voice signal;

calculating the suppression gain based on the estimated noise element spectrum, the voice information, and the output of the analysis unit, and providing a calculation result for the suppression unit; and estimating an average power value, as a voice signal, indicating a number of samples totalized from a largest power as a predetermined ratio of a number of samples in a power distribution in each frequency of pure voice for a plurality of input voice signal frames in estimating the voice information, and a power Pki of a current frame for each frequency and a spectrum power average value PMAXki at a predetermined higher rate in a spectrum power of a noise superposed voice signal and an estimated noise spectrum Nki are used to calculate the suppression gain Gki as follows:

$$d1ki=PMAXki-Pki \quad 0\leqq i<N$$

$$d2ki=PMAXki-Nki \quad 0\leqq i<N$$

$$Gki=g(d1ki,d2ki) \quad 0\leqq i<N$$

$$g(d1ki,d2ki)=\tau-\kappa\cdot d1ki+\mu\cdot d2ki \quad 0\leqq i<N$$

wherein, τ, κ, and μ are positive coefficients.

13. A computer-readable storage medium storing a program used to direct a computer for reducing noise by performing of analyzing a frequency of an input voice signal and converting the signal into a signal of a frequency area, suppressing the signal of the frequency area, and synthesizing and outputting a suppressed signal of a time area using the suppressed signal of the frequency area, performing:

estimating, using a process result of analyzing the input voice signal, the information for use as basic information in calculating a suppression gain of a signal, which is the information corresponding to at least the pure voice element excluding a noise element in the input voice signal;

calculating the suppression gain based on the estimated voice information and the process result of analyzing the input voice signal, and providing a calculation result for suppressing the signal; and estimating an average power value, as a voice signal, indicating a number of samples totalized from a largest power as a predetermined ratio of a number of samples in a power distribution in each frequency of pure voice for a plurality of input voice signal frames in estimating the voice information, and a power Pki of a current frame for each frequency and a spectrum power average value PMAXki at a predetermined higher rate in a spectrum power of a noise superposed voice signal are used to calculate the suppression gain Gki as follows:

$$dki=PMAXki-Pki \quad 0\leqq i<N$$

$$Gki=f(dki) \quad 0\leqq i<N$$

14. A computer-readable storage medium storing a program used to direct a computer for reducing noise by analyzing a frequency of an input voice signal and converting the signal into a signal of a frequency area, suppressing the signal of the frequency area, and synthesizing and outputting a suppressed signal of a time area using the suppressed signal of the frequency area, performing:

estimating the spectrum of a noise element in the input voice signal;

estimating, using a process result of the analyzing step, the information for use as basic information in calculating a suppression gain of a signal, which is the information corresponding to at least the pure voice element excluding a noise element in the input voice signal;

calculating the suppression gain based on the estimated noise element spectrum, the voice information, and a process result of the analyzing step, and providing a calculation result for suppressing the signal; and estimating an average power value, as a voice signal, indicating a number of samples totalized from a largest power as a predetermined ratio of a number of samples in a power distribution in each frequency of pure voice for a plurality of input voice signal frames in estimating the voice information, and a power Pki of a current frame for each frequency and a spectrum power average value PMAXki at a predetermined higher rate in a spectrum power of a noise superposed voice signal and an estimated noise spectrum Nki, are used to calculate the suppression gain Gki as follows:

$$d1ki=PMAXki-Pki \quad 0\leqq i<N$$

$$d2ki=PMAXki-Nki \quad 0\leqq i<N$$

$$Gki=g(d1ki,d2ki) \quad 0\leqq i<N$$

$$g(d1ki,d2ki)=\tau-\kappa\cdot d1ki+\mu\cdot d2ki \quad 0\leqq i<N$$

wherein, τ, κ, and μ are positive coefficients.

* * * * *